US007708398B2

(12) United States Patent
Niioka et al.

(10) Patent No.: US 7,708,398 B2
(45) Date of Patent: May 4, 2010

(54) PRINTING APPARATUS AND PRINTING METHOD

(75) Inventors: Koji Niioka, Tatsuno-machi (JP); Takuya Yasue, Matsumoto (JP); Hitoshi Igarashi, Shiojiri (JP); Kazuhisa Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 251 days.

(21) Appl. No.: 11/903,782

(22) Filed: Sep. 25, 2007

(65) Prior Publication Data

US 2008/0074458 A1 Mar. 27, 2008

(30) Foreign Application Priority Data

Sep. 25, 2006 (JP) ..... 2006-259086

(51) Int. Cl.
*B41J 2/01* (2006.01)

(52) U.S. Cl. ..... 347/104; 271/65; 271/186

(58) Field of Classification Search ..... None
See application file for complete search history.

(56) References Cited

U.S. PATENT DOCUMENTS 4,745,490 A * 5/1988 Shimizu et al. ..... 358/300
5,672,019 A 9/1997 Hiramatsu et al.
6,984,082 B2 1/2006 Endo
2001/0000462 A1 * 4/2001 Blackman et al. ..... 399/13

FOREIGN PATENT DOCUMENTS

| | | |
|---|---|---|
| CN | 1089566 A | 7/1994 |
| CN | 1564753 A | 1/2005 |
| JP | 60-46252 | 4/1985 |
| JP | 08-259037 | 10/1996 |
| JP | 2004-268512 | 9/2004 |

* cited by examiner

*Primary Examiner*—Matthew Luu
*Assistant Examiner*—Justin Seo
(74) *Attorney, Agent, or Firm*—Nutter McClennen & Fish LLP; John J. Penny, Jr.

(57) ABSTRACT

A printing apparatus includes: (A) a transport mechanism transporting a medium in a forward direction and a backward direction; (B) a head printing dots on the medium; (C) a sensor sensing existence of the medium in a non-contact manner; (D) a reversion mechanism reversing the medium; and (E) a controller controlling the sensor to sense an end of the medium when the transport mechanism transports the medium in the forward direction so as to allow the head to print the dots on the surface of the medium and controlling the sensor to sense the end of the medium when the transport mechanism transports the medium in the backward direction so as to allow the reversion mechanism to reverse the medium after the dots are printed on the surface thereof.

5 Claims, 22 Drawing Sheets

PRINTING APPARATUS AND PRINTING METHOD

BACKGROUND

1. Technical Field

The present invention relates to a printing apparatus and a printing method.

The printing apparatus is not limited to a printer, copier, and a facsimile which perform a printing process in an ink jet manner, but broadly includes apparatuses used to manufacture a color filter of a liquid crystal display, an organic EL display, a biochip, etc.

2. Related Art

As an example of such a printing apparatus, an ink jet printer is known. A typical ink jet printer prints images by alternately performing a dot formation process in which a moving head ejects ink to form dots and a transport process in which a medium (paper, fabric, OHP paper, etc) is transported.

Such a printer may include a sensor for sensing the end of the medium. In addition, such a sensor may include a lever arranged so as to rotatably move in the way of a transport path of the medium and a photo interrupter for changing a signal level of a detection signal in response to movement of the lever (for example, see JP-A-8-259037).

In a sensor using such a lever, paper may be jammed when the paper is transported in a backward direction.

SUMMARY

An advantage of some aspects of the invention is that it provides a printing apparatus capable of sensing the end of a medium with no danger of medium jam occurring in backward transport.

According to an aspect of the invention, there is provided a printing apparatus including: (A) a transport mechanism transporting a medium in a forward direction and a backward direction; (B) a head printing dots on the medium; (C) a sensor sensing existence of the medium in a non-contact manner; (D) a reversion mechanism reversing the medium; and (E) a controller controlling the sensor to sense an end of the medium when the transport mechanism transports the medium in the forward direction so as to allow the head to print the dots on the surface of the medium and controlling the sensor to sense the end of the medium when the transport mechanism transports the medium in the backward direction so as to allow the reversion mechanism to reverse the medium after the dots are printed on the surface thereof.

Other features of the invention are apparent from the following description and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
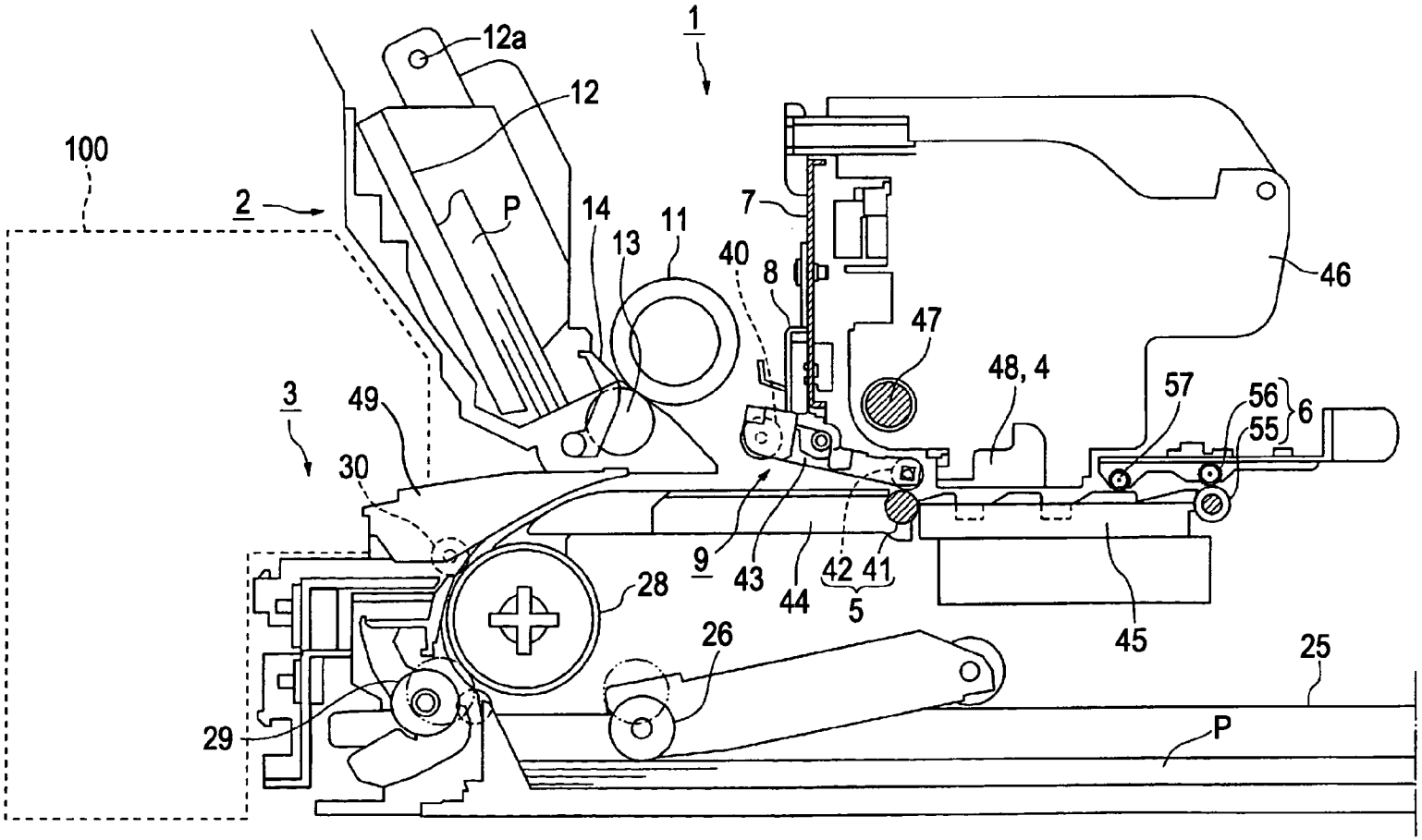
FIG. 1 is a schematic diagram illustrating a lateral end surface of a printer.

The following descriptive features are apparent from the following description and the accompanying drawings.

A printing apparatus includes (A) a transport mechanism transporting a medium in a forward direction and a backward direction; (B) a head printing dots on the medium; (C) a sensor sensing existence of the medium in a non-contact manner; (D) a reversion mechanism reversing the medium; and (E) a controller controlling the sensor to sense an end of the medium when the transport mechanism transports the medium in the forward direction so as to allow the head to print the dots on the surface of the medium and controlling the sensor to sense the end of the medium when the transport mechanism transports the medium in the backward direction so as to allow the reversion mechanism to reverse the medium after the dots are printed on the surface thereof.

In the printing apparatus with the above-described configuration, it is possible to sense the end of the medium with no danger of medium jam occurring in the backward transport.

The sensor may include a light-emitting portion and a light-receiving portion, and the printing apparatus may further includes a lower guide and an upper guide for guiding the medium between the light-emitting portion and the light-receiving portion. In this way, it is possible to shorten a distance between the light-emitting portion and the light-receiving portion and to pass the medium between the light-emitting portion and the light-receiving portion.

The sensor may include an upper protrusion portion and a lower protrusion portion, the upper protrusion portion may include one of the light-emitting portion and the light-receiving portion and the lower protrusion portion includes the other thereof, the lower guide may include a base surface, ribs protruding upward from the base surface so as to contact the medium, and an insertion portion for inserting the lower protrusion portion, and an opening may be provided at a position of an optical axis of the sensor in the lower guide and the opening is formed in the base surface between the ribs. In this way, it is possible to prevent the medium from becoming jammed.

The top surface of the lower protrusion portion may be positioned above the base surface of the lower guide. In this way, it is possible to improve sensing precision of the sensor.

The lower guide may further include an uplift portion covering the lower protrusion portion, and an inclined plane may be formed between the base surface on an upstream side and a downstream side of the uplift portion in the forward direction. In this way, it is possible to prevent the medium from becoming jammed.

The printing apparatus may further include a flexible seal member. In the printing apparatus, the sensor may be fixed to the lower guide, the upper guide may be pivotable on the lower guide, and the seal member may seal a boundary between the sensor and the upper guide. In this way, it is possible to prevent the medium from becoming inserted into the boundary between the relatively pivotable upper guide and the sensor.

The printing apparatus may further include: a first bulge supporting the medium; a second bulge supporting the medium and being provided on a more downstream side in the forward direction than the first bulge; and a groove formed between the first bulge and the second bulge. In the printing apparatus, the controller may control the transport mechanism to transport the medium so as not to position the rear of the medium on the more downstream side of the forward direction than the first bulge, and simultaneously controls the head to print the dots on one surface of the medium. In addition, the controller may control the transport mechanism to transport the medium so as to position the rear of the medium in the groove, and simultaneously controls the head to print the dots on the rear end of the medium while printing the dots on the other-side of the medium. In this way, when the medium is transported backward after the printing process of the dots on the surface, it is difficult for the rear end of the medium to become jammed in the first bulge, thereby preventing the medium from becoming jammed.

A printing method includes: feeding a medium to a transport mechanism; sensing the end of the medium with a non-contact sensor before feeding the medium to the transport mechanism; printing dots on a surface of the medium while the transport mechanism transports the medium in a forward direction; transporting the medium in a backward direction, which is a direction opposite to the forward direction in order that a reversion mechanism reverses the medium after printing the dots on the surface of the medium; and sensing the end of the medium by means of the non-contact sensor when the medium is transported in the backward direction.

According to such a printing method, it is possible to sense the end of the medium in a manner in which the medium does not become jammed at the time of the backward transport.

Overview of Printer

Figure 2:
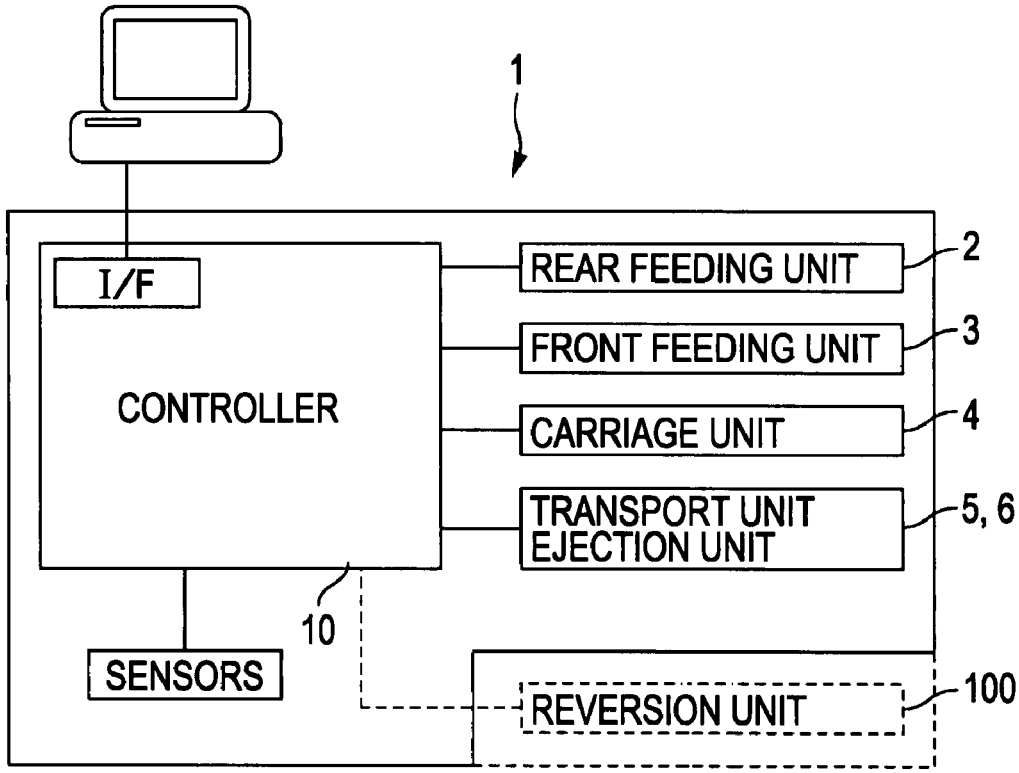
FIG. 2 is a block diagram illustrating an overall configuration of the printer.

FIG. 1 is a schematic diagram illustrating a lateral end surface of the printer. FIG. 2 is a block diagram illustrating an overall configuration of the printer.

A printer 1 includes a rear feeding unit 2, a front feeding unit 3, a carriage unit 4, a transport unit 5, an ejection unit 6, and a controller 10.

The rear feeding unit 2 is a mechanism for feeding paper sheet P, which stocks in a rear surface of the printer 1, to the transport unit 5. The front feeding unit 3 is a mechanism for feeding the paper sheet P from a tray 25, which can be attached to a front surface of the printer 1, to the transport unit 5. The carriage unit 4 is a mechanism for allowing a head 48 to eject ink in order to form an image on the paper sheet P while moving to a carriage 46. The carriage 46 is guided by a shaft 47 so as to move in the vertical direction of FIG. 1. The transport unit 5 is a mechanism for transporting the fed paper sheet P and control the position of the paper sheet P relative to the head 48. The ejection unit 6 is a mechanism for ejecting the paper on which the image is formed to outside of the printer 1. The controller 10 controls the entirety of the printer 1 so as to control each unit on the basis of print data received from outside apparatuses.

The printer 1 can optionally retain a reversion unit 100. The reversion unit 100 is a mechanism for reversing the paper sheet P when both surfaces of the paper sheet P are to be printed upon. Various sensors (sensor group) are provided in the printer 1. As described below, an optical sensor 37 is included in the sensor group. The controller 10 controls each unit on the basis of the sensing result of the sensor group.

As guide members for guiding the paper during feeding or transport, a guide roller 40, an upper guide 43, a lower guide 44, and a platen 45 are provided in the printer 1.

Path of Paper Sheet P

Rear Feeding

A path of the paper sheet P during rear feeding will be described with reference to FIG. 1. In addition, timing of operation and drive of each member is controlled by the controller 10.

At the time of starting the feeding process, a hopper 12 is raised about a supporting point 12*a* so that the uppermost sheet of the paper sheet P stacked in the hopper 12 comes in contact with a feeding roller 11. When a rear feeding roller 11 rotates, the paper sheet P is fed to a downstream side. The fed paper sheet P is inserted between the rear feeding roller 11 and a retardation roller 13. A torque limiter mechanism applies a predetermined rotation resistance to the retardation roller 13 in order to prevent two sheets of the paper sheet P from being transported at once. The sheet of the paper sheet P stopped by the retardation roller 13 is returned to the hopper 12 by a returning lever 14.

Figure 3:
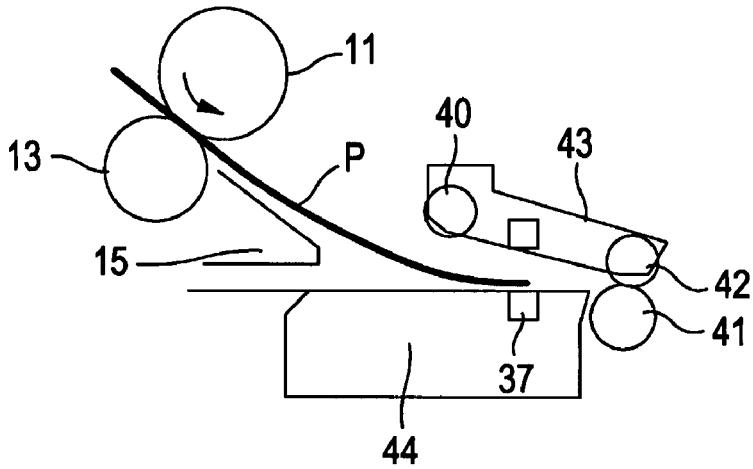
FIG. 3 is diagram illustrating a path of rear feeding.

FIG. 3 is diagram illustrating a path of rear feeding. The rotation of the rear feeding roller 11 induces the paper sheet P to be fed from hopper 12 to the inside of the printer 1. Generally, the front end of the fed paper sheet P is guided downward to the right by the rear feeding guide 15. Moreover, when the rear feeding roller 11 continues to rotate, the front end of the paper sheet P comes in contact with the lower guide 44, and is then guided rightward by the lower guide 44. When the paper sheet P is bent upward, the front end of the paper sheet P comes in contact with an upper guide 43 or the guide roller 40 so as to be guided rightward by the upper guide 43. The front end of the paper sheet P guided by the upper guide 43 or the lower guide 44 passes through the optical sensor 37, which is described below, and reaches the transport unit 5.

Front Feeding

Figure 4:
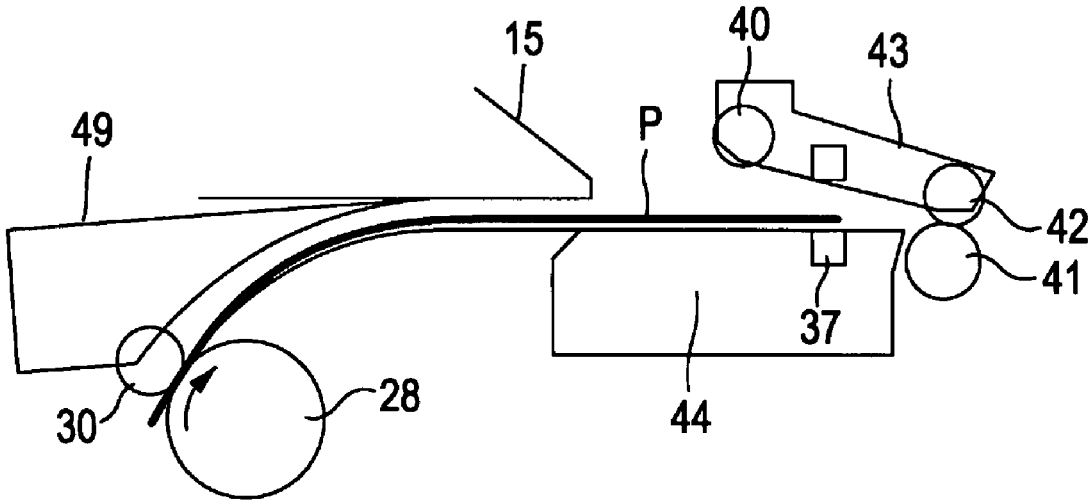
FIG. 4 is a diagram illustrating a path of front feeding.

FIG. 4 is a diagram illustrating a path of front feeding. Hereinafter, the path of the paper sheet P at the time of front feeding will be described with reference to FIG. 1.

In the tray 25, a pick-up roller 26 comes in contact with the uppermost sheet of the paper sheet P. At this time, when the pick-up roller 26 rotates, the paper sheet P continues to be moved to the front feeding roller 28. The paper sheet P that continues to be moved from the tray 25 is inserted between the front feeding roller 28 and a separating roller 29, and then continues to be moved to an assist roller 30 by rotation of the front feeding roller 28 while double sheet feeding is prevented by the separating roller 29. The continuous rotation of the front feeding roller 28 induces the paper sheet P inserted between the front feeding roller 28 and the assist roller 30 to be fed. At this time, the front end of the paper sheet P raises the hopper 49, and then a lower surface of the hopper 49 guides the paper sheet P rightward. While the front end of the paper sheet P guided by the hopper 49 is guided by the upper guide 43 or the lower guide 44, the front end of the paper sheet P passes through the optical sensor 37, which is described below, and then reaches the transport unit 5.

Transport and Ejection

Figure 5A:
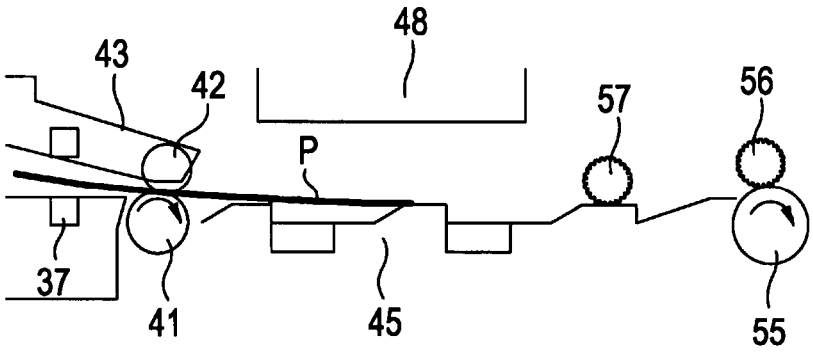
FIGS. 5A to 5C are diagrams explaining transport and ejection.
Figure 5B:
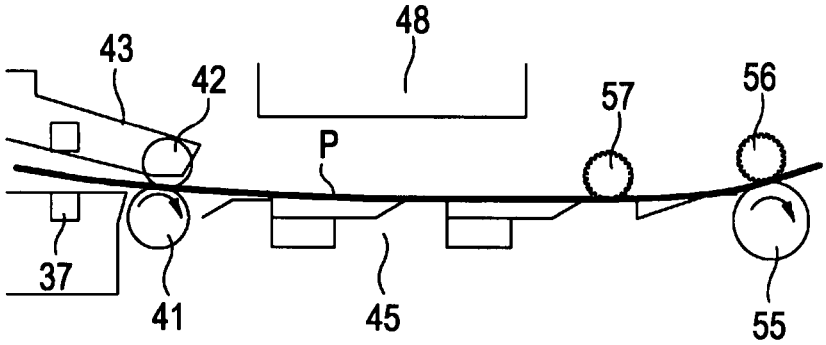
Figure 5C:
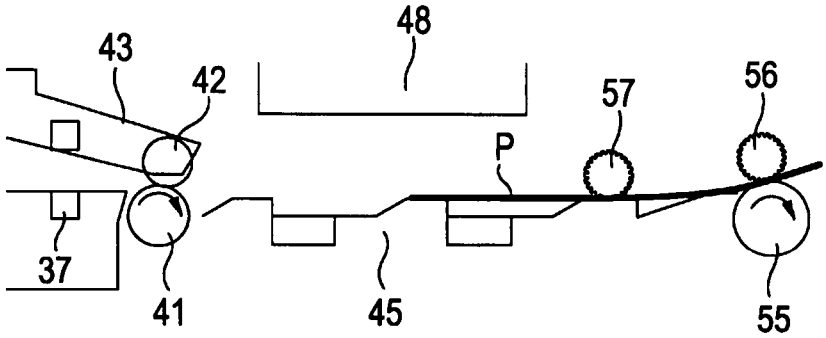

FIGS. 5A to 5C are diagrams explaining transport and ejection. Hereinafter, transport of the paper sheet P by the transport unit 5 will be described with reference to FIG. 1.

The paper sheet P fed from the rear feeding unit 2 or the front feeding unit 3 is inserted into a transport roller 41 of the transport unit 5 and a driven roller 42. While an amount of rotation of the transport roller 41 is controlled by a controller 10 and a position of the paper sheet P relative to the head 48 is controlled, the paper sheet P is transported. That is, the paper sheet P is transported by the transport roller 41. At this time, the paper sheet P is supported by the platen 45 from below. In addition, as described below, a groove for carrying out the printing process with no margin is provided in the platen 45.

When the paper sheet P is transported to a position opposite the head 48, an image formed by numerous dots is printed on the paper sheet P by a dot formation process in which dots are formed on the paper sheet P by ejecting ink from the head 48 while the carriage 46 and a transport process in which the paper sheet P is transported by a predetermined amount are alternately performed. When the transport process is carried out several times, the front end of the paper sheet P passes through the auxiliary roller 57. In addition, when the process is further carried out several times, the front end of the paper sheet P reaches the ejection unit 6 (where the paper sheet P is inserted between the ejection roller 55 and an ejection-side driven roller 56).

After the front end of the paper sheet P reaches the ejection unit 6, the paper sheet P is transported by the transport roller 41 and the ejection roller 55. The transport roller 41 and the ejection roller 55 are controlled so as to be synchronized with each other. At this time, when the transport process is carried out several times, the rear end of the paper sheet P passes through the optical sensor 37, which is described below, and then passes through the transport roller 41.

The rear end of the paper sheet P passes through the transport roller 41, and then an amount of rotation of the ejection roller 55 is controlled by the controller 10. At this time, the paper sheet P is transported while the position of the paper sheet P relative to the head 48 is controlled. That is, the paper sheet P is transported by the ejection roller 55. When the printing process of the image on the paper sheet P is finished, the controller 10 further rotates the ejection roller 55 to eject the paper sheet P.

When the transport roller 41 or the ejection roller 55 is reversely rotated, as described below, the paper sheet P can be transported in a reverse direction (reverse transport). When transporting the paper sheet P to the reversion unit 100 to reverse the paper sheet P, the paper sheet P is reversely transported. When the reverse transport is carried out in a state where the rear end of the paper sheet P passes through the transport roller 41 and is placed on the platen 45, the rear end of the paper sheet P passes through the transport roller 41, and afterward passes through the optical sensor 37. In this case, when the reverse transport continues, the front end of the paper sheet P sequentially passes through ejection roller 55, the transport roller 41, and the optical sensor 37.

Reversion

Figure 6:
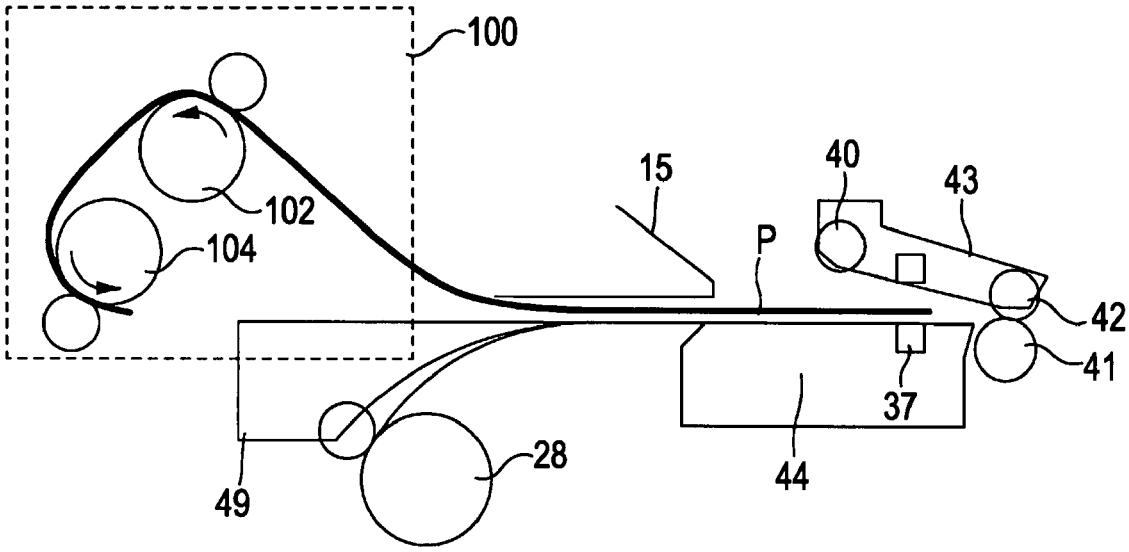
FIG. 6 is a diagram illustrating a path of reversion.

FIG. 6 is a diagram explaining a path of reversion.

The paper sheet P reversely transported from the transport unit 5 is supplied to the reversion unit 100. The paper supplied to the reversion unit 100 is guided upward to the left by an uplift mechanism (not shown), and then reaches a first roller 102. The first roller 102 is configured to rotate in synchronization with the transport roller 41. An amount of rotation of the first roller 102 is controlled by the controller 10 so that the paper sheet P is supplied to a second roller 104. The second roller 104 is configured so as to rotate in synchronization with the first roller 102. That is, an amount of rotation of the second roller 104 is also controlled by the controller 10. When the second roller 104 rotates, the paper sheet P presses the hopper 49 downward so that the paper sheet P is guided rightward by the upper surface of the hopper 49.

Before the paper sheet P is supplied to the reversion unit 100, the image is printed on the upper surface of the paper sheet P. When the paper sheet P is supplied to the reversion unit 100, and then reaches the reversion unit 5, the printed surface is turned downward and the back surface of the paper sheet P is turned upward. In the following description, the upper surface of the paper sheet P before the reversion is referred to as "a one surface" and the back surface of the paper sheet P after the reversion is "the other surface".

The front end of the paper sheet P at the time of printing the one surface becomes the rear end of the paper sheet P at the time of printing the other surface. In addition, the rear end of the paper sheet P at the time of printing the one surface becomes the front end of the paper sheet P at the time of printing the other surface. In the following description, after the paper sheet P is supplied from the reversion unit 100 to the transport unit 5, the head end (the rear end of the paper sheet P at the time of printing the one surface) of the paper sheet P is replaced with "a front end" and the tail end (the front end of the paper sheet P at the time of printing the one surface) of the paper sheet P is replaced with "a rear end".

In the following description, the time when the paper sheet P is transported from the feeding unit to the transport unit, time when the paper sheet P is transported from the reversion unit to the transport unit, or time when the paper sheet P is transported from the transport unit to the ejection unit is referred to as "forward transport" irrespective of reversion of the front and rear ends. Conversely, the time when the paper sheet P is transported from the transport unit to the reversion unit or time when the paper sheet P is transported from the ejection unit to the reversion unit is referred to as "backward transport".

Optical Sensor 37

Configuration of Optical Sensor 37

Figure 7:
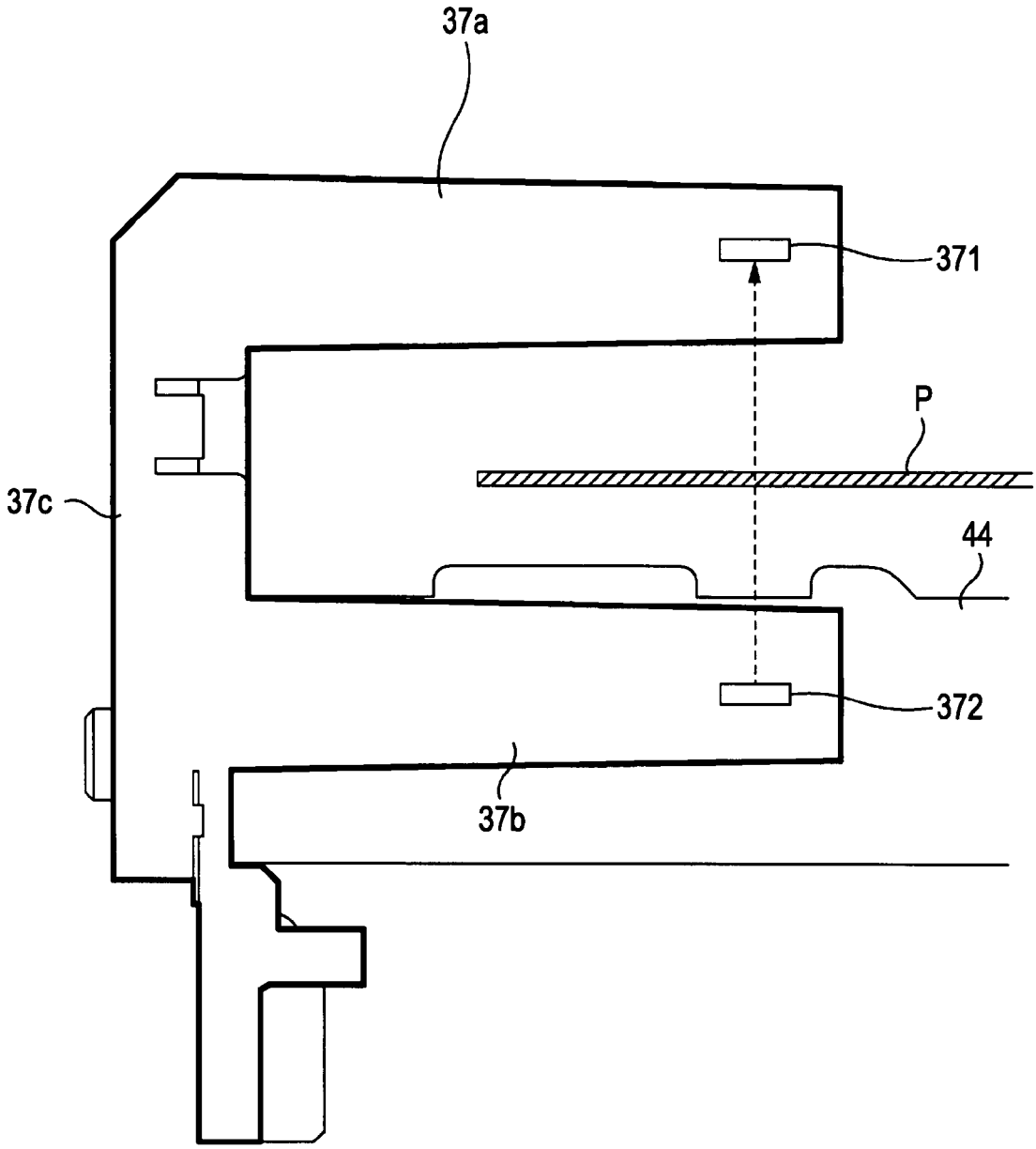
FIG. 7 is a diagram illustrating an optical sensor from view of feeding side.

FIG. 7 is a diagram illustrating the optical sensor 37 when viewed from feeding side. A solid line shown in FIG. 7 is the optical sensor 37. A diagonal line shown in FIG. 7 is a lateral side of the paper sheet P.

The optical sensor 37 has a C shape. That is, the optical sensor 37 includes an upper protrusion portion 37*a*, a lower protrusion portion 37*b*, and a support portion 37*c*. A light-receiving portion 371 is provided in the upper protrusion portion 37*a* and a light-emitting portion 372 is provided in the lower protrusion portion 37*b*. The light-receiving portion 371 which is positioned above the light-emitting portion 372 senses light emitted from the light-emitting portion 372.

Since the light-receiving portion 371 is provided in the upper side and a light receiving surface of the light-receiving portion 371 faces downward, dust does not settle in the light receiving surface. Accordingly, it is possible to carry out a stable sensing process. In order to maintain a precision of the position between the light-receiving portion 371 and the light-emitting portion 372, the upper protrusion portion 37*a* and the lower protrusion portion 37*b* are incorporated with each other through the support portion 37*c* (in this way, the optical sensor 37 has the ⊂ shape).

Sensing of Optical Sensor 37

When the light-receiving portion 371 senses light emitted from the light-emitting portion 372, the optical sensor 37 outputs a signal of an H level. Alternatively, when the light-receiving portion 371 does not sense light emitted from the emitting portion 372, the optical sensor 37 outputs a signal of an L level. When the paper sheet P is placed in the optical sensor 37, the paper sheet P cuts an optical axis of the optical sensor 37. Accordingly, the light-receiving portion 371 cannot sense the light emitted from the light-emitting portion 372, and thus the optical sensor 37 outputs the signal of the L level. In this way, the controller 10 can detect whether there is the paper sheet P placed in the optical sensor 37 on the basis of the output of the optical sensor 37.

As described below, the controller 10 can detect where the end of the paper sheet P is placed, on the basis of timing of change in the output of the optical sensor 37.

Figure 8A:
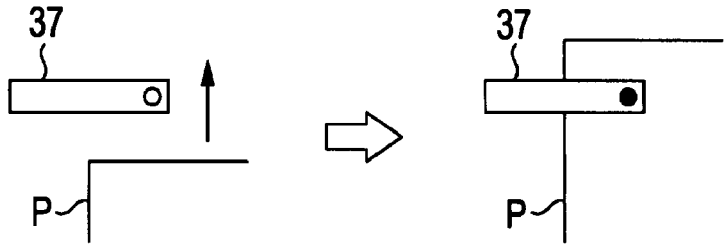
FIG. 8A is a diagram explaining detection of the front end of paper sheet P at the time of forward transport.

FIG. 8A is a diagram explaining detection of the front end of paper sheet P at the time of the forward transport (when viewed from top). When the front end of the paper sheet P passes through the optical sensor 37, as shown in FIG. 8A, the output of the optical sensor 37 is changed from the H level to the L level. In this way, when the output of the optical sensor 37 is changed from the H level to the L level at the time of the forward transport, the controller 10 can detect the front end of the paper sheet P.

Figure 8B:
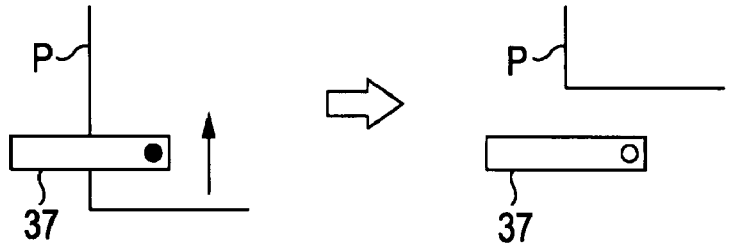
FIG. 8B is a diagram explaining detection of the rear end of the paper sheet P at time of forward transport.

FIG. 8B is a diagram explaining detection of the rear end of paper sheet P at the time of the forward transport. When the rear end of the paper sheet P passes through the optical sensor 37, as shown in FIG. 8B, the output of the optical sensor 37 is changed from the L level to the H level. In this way, when the output of the optical sensor 37 is changed from the L level to the H level at the time of the forward transport, the controller 10 can detect the rear end of the paper sheet P.

Figure 8C:
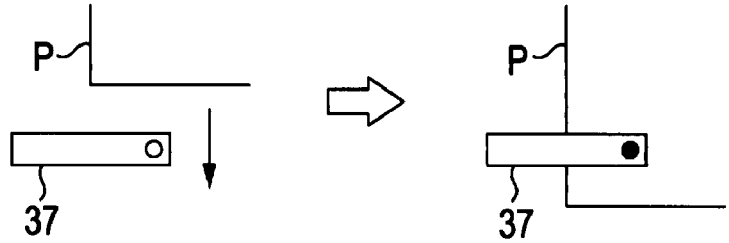
FIG. 8C is a diagram explaining detection of the rear end of the paper sheet P at time of backward transport.

FIG. 8C is a diagram explaining detection of the rear end of paper sheet P at the time of the backward transport. When the rear end of the paper sheet P passes through the optical sensor 37, as shown in FIG. 8C, the output of the optical sensor 37 is changed from the H level to the L level. In this way, when the output of the optical sensor 37 is changed from the H level to the L level at the time of the backward transport, the controller 10 can detect the rear end of the paper sheet P.

Figure 8D:
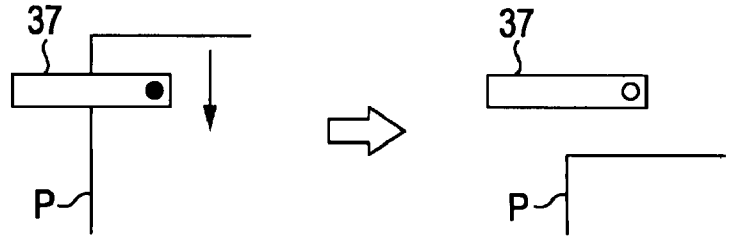
FIG. 8D is a diagram explaining detection of the front end of the paper sheet P at time of backward transport.

FIG. 8D is a diagram explaining detection of the front end of paper sheet P at the time of the backward transport. When the rear end of the paper sheet P passes through the optical sensor 37, as shown in FIG. 8D, the output of the optical sensor 37 is changed from the L level to the H level. In this way, when the output of the optical sensor 37 is changed from the L level to the H level at the time of the backward transport, the controller 10 can detect the front end of the paper sheet P.

Lower Guide 44

Figure 9A:
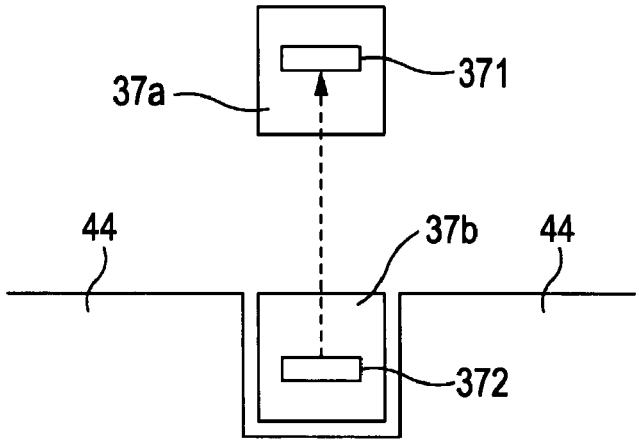
FIGS. 9A and 9B are diagrams explaining a comparative example.
Figure 9B:
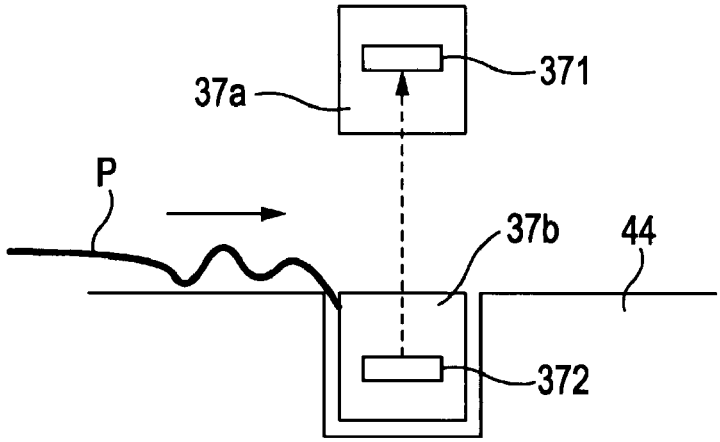

FIGS. 9A and 9B are diagrams explaining a comparative example. The lower protrusion portion 37*b* is required to be inserted into the lower guide 44 in order to pass the paper sheet P guided to the lower guide 44 between the upper protrusion portion 37*a* and the lower protrusion portion 37*b* of the optical sensor 37. Meanwhile, the upper surface of the light-emitting portion 372 is required to be exposed through the lower guide 44 in order to allow the light emitted from the light-emitting portion 372 to be received by the light-receiving portion 371. In this case, like the comparative example, when the lower protrusion portion 37*b* is inserted into the lower guide 44 during the exposure of the top surface of the lower protrusion portion 37*b*, the front end of the paper sheet P is interrupted by a boundary between the lower guide 44 and the lower protrusion portion 37*b*. Accordingly, the paper sheet P may become jammed.

Figure 9C:
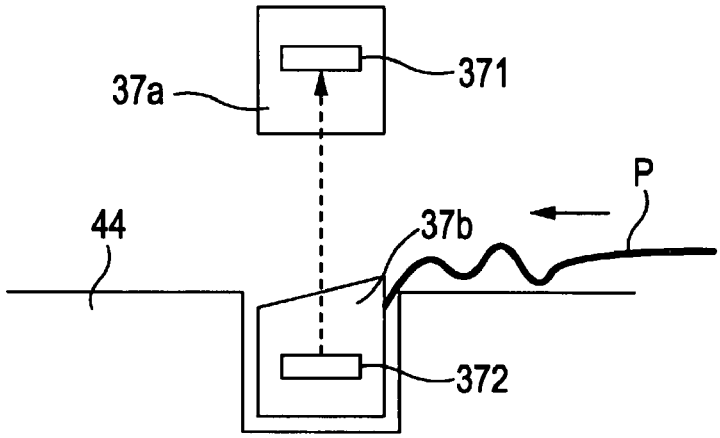
FIG. 9C is a diagram explaining another comparative example.

FIG. 9C is a diagram explaining another comparative example. In this comparative example, since the paper sheet P is not inserted into the boundary between the lower guide 44 and the lower protrusion portion 37*b* at the time of the forward transport of the paper sheet P, a height on the downstream side of the transport direction of the boundaries between the lower guide 44 and the lower protrusion portion 37*b* is lowered. However, in such a configuration, when the paper sheet P is transported backward, the paper sheet P may become inserted into the boundary between the lower guide 44 and the lower protrusion portion 37*b*.

In this embodiment, the lower protrusion portion 37*b* is inserted into the lower guide 44 in the following manner. Moreover, in the configuration according to this embodiment described below, the paper can be prevented from becoming jammed even when transported backward.

Figure 10:
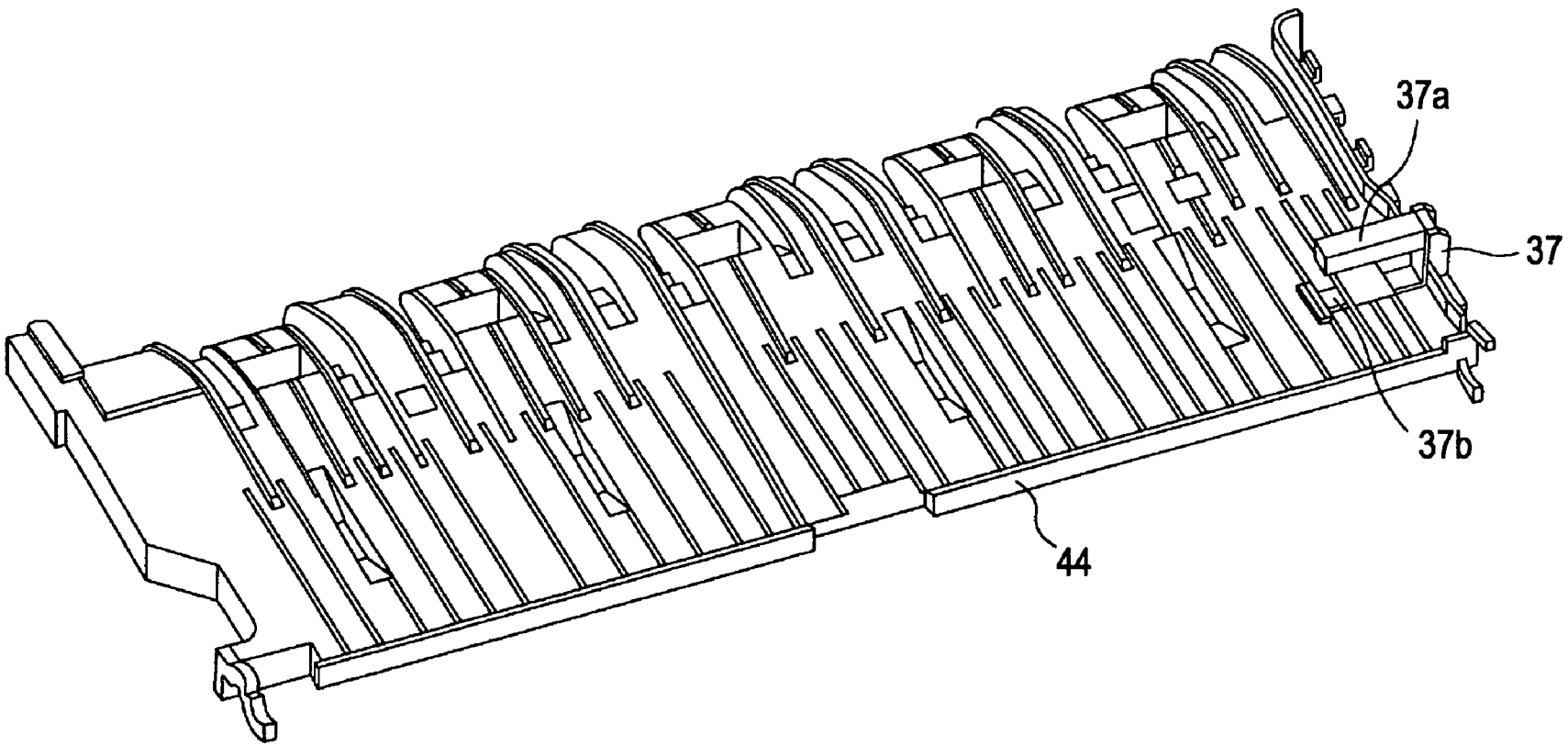
FIG. 10 is a diagram illustrating a configuration of a lower guide.
Figure 11:
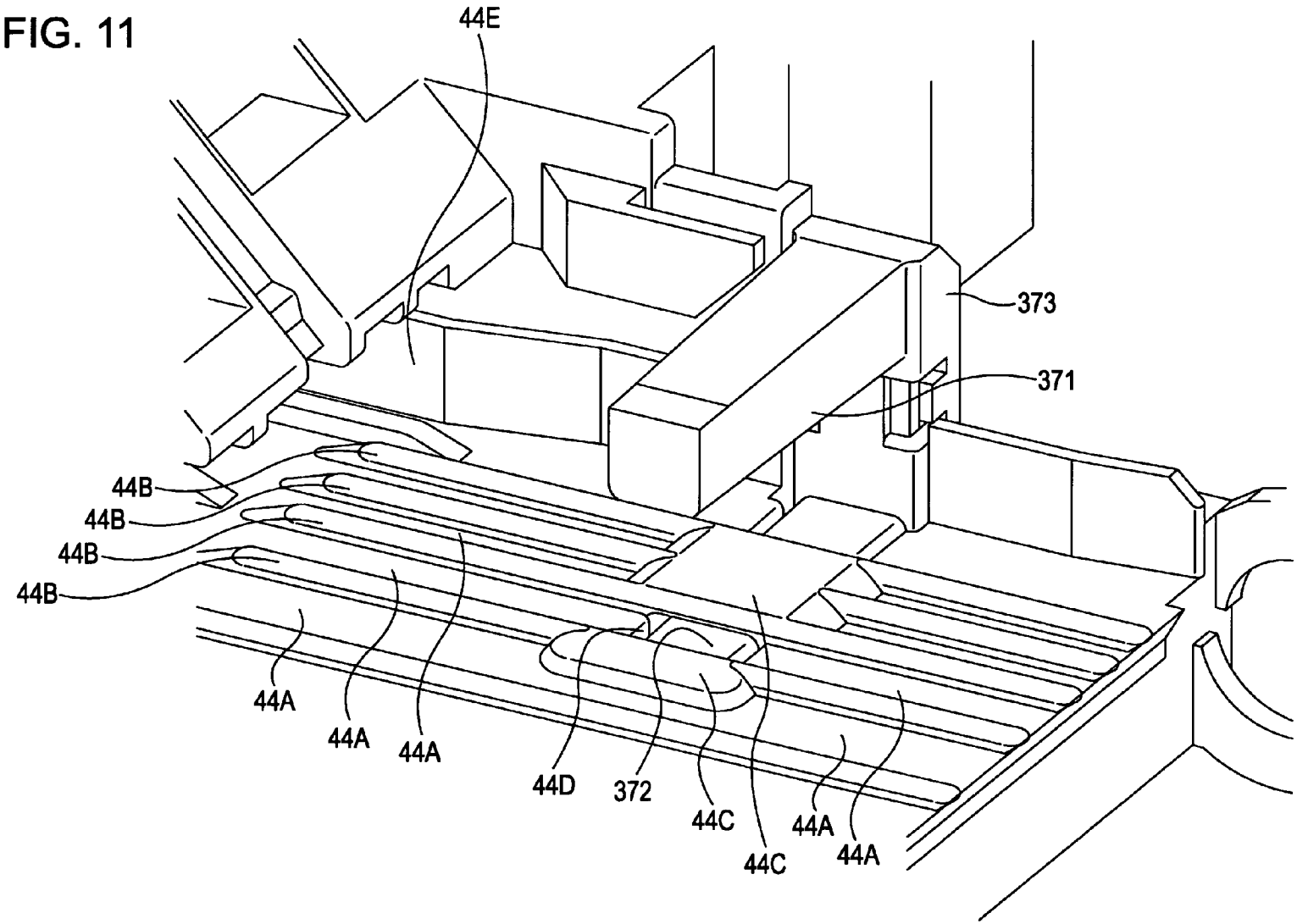
FIG. 11 is a diagram illustrating the lower guide at the vicinity of the optical sensor.

FIG. 10 is a diagram illustrating a configuration of lower guide 44. FIG. 11 is a diagram illustrating a configuration of the lower guide 44 in the vicinity of the optical sensor 37. Hereinafter, the lower guide 44 will be described with reference with FIGS. 10 and 11.

A plurality of ribs 44B are provided in the lower guide 44. The ribs protrude upward from a base surface 44A and extend along a direction of transport of the paper sheet P. When the lower guide 44 guides the paper 4, the paper sheet P is supported by the ribs 44B. The ribs 44B prevent the paper sheet P from becoming adhered to the base surface 44A due to static electricity and the like.

The optical sensor 37 described above is provided in the lateral end of the lower guide 44. The lower protrusion portion 37*b* of the optical sensor 37 is inserted into the lower guide 44 (where an insertion portion for inserting the lower protrusion portion 37*b* is provided in the lower guide 44). Moreover, the optical sensor 37 is fixed on the lower guide 44 in the support portion 37*c*.

A top surface of the lower protrusion portion 37*b* of the optical sensor 37 (excluding an upper portion of the light-emitting portion 372) is covered with the uplift portion 44C of the lower guide 44. An inclined plane is configured between the uplift portion 44C and the base surface 44A. In this way, by configuring the uplift portion 44C, it is possible to prevent the front end (the rear end at time of backward transport) of the paper sheet P from becoming jammed in the boundary between the lower guide 44 and the lower protrusion portion 37*b*.

An opening 44D is provided in the lower guide 44. The light-emitting portion 372 of the optical sensor 37 is positioned below the opening 44D and the optical axis of the optical sensor 37 passes through the opening 44D. That is, the lower protrusion portion 37*b* of the optical sensor 37 is exposed through the opening 44D. The opening 44D is provided in the base surface between the ribs 44B. Since the opening 44D is provided in such a position, it is possible to prevent the front end (the rear end at time of the backward transport) of the paper sheet P from becoming jammed in the boundary between the lower guide 44 and the lower protrusion portion 37*b* (in addition, if the opening 44D is provided in the rib 44B, the front end (or the rear end) of the paper sheet P may be inserted into the boundary between the rib 44B and the lower protrusion portion 37*b*).

The height of the uplift portions 44C is configured to be the same as that of the ribs 44B. Accordingly, it is possible to prevent the front end (the rear end at the time of the backward transport) of the paper sheet P from becoming inserted into the boundary between the ribs 44B and the uplift portions 44C. The surface of the uplift portion 44C is positioned above the top surface of the lower protrusion portion 37*b* of the optical sensor 37. In this way, it is possible to prevent the front end (the rear end at the time of the backward transport) of the paper sheet P from becoming inserted into the boundary between the lower guide 44 and the lower protrusion portion 37*b*.

The height of the base surface 44A may be different from that of the top surface of the lower protrusion portion 37*b* of the optical sensor 37. In this embodiment, the height of the lower protrusion portion 37*b* is larger than that of the base surface 44A (see FIG. 17). In this way, it is possible to shorten a distance between the light-emitting portion 372 and the light-receiving portion 371 as much as possible. Accordingly, it is possible to improve a sensing precision of the optical sensor 37.

When the paper sheet P is fed, the lateral side of the paper sheet P is guided to a lateral guide surface 44E of the lower guide 44 irrespective of a size of the paper sheet P. The lateral guide surface 44E is formed more closely to the paper sheet P than the inside of the support portion 37*c* of the optical sensor 37. Such a configuration can prevent the lateral side of the paper sheet P from coming in contact with the inside of the support portion 37*c* of the optical sensor 37 (see the positional relationship between the lateral end (the lateral side) of the paper sheet P and the support portion 37*c*). In this way, it is possible to prevent the front end (the rear end of the backward transport) of the paper sheet P from becoming inserted into the boundary between the inside surface of the support portion 37*c* of the optical sensor 37 and the lower guide 44.

Upper Guide 43

Configuration of Peripheral Members of Upper Guide 43

Figure 12:
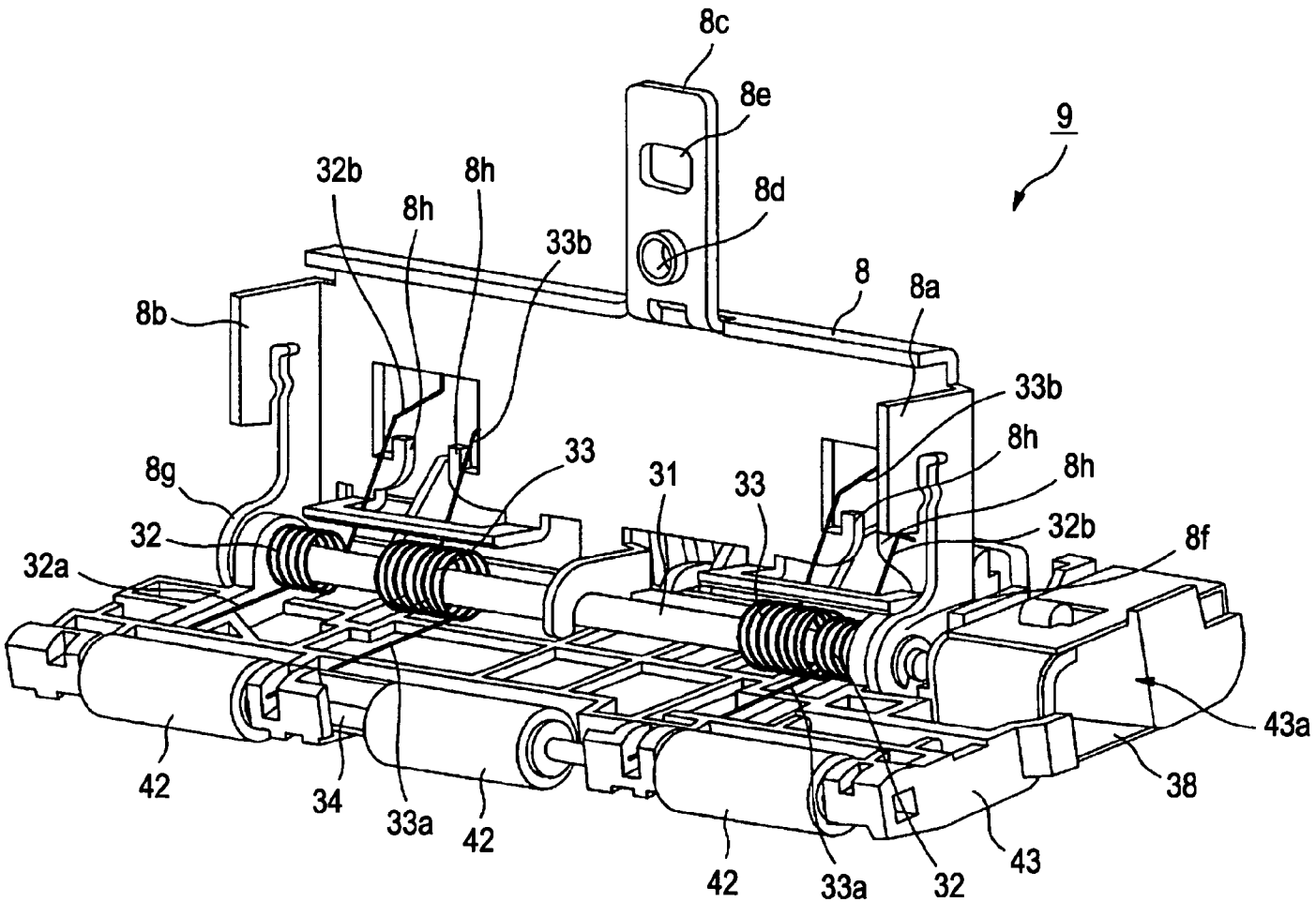
FIG. 12 is a diagram illustrating an upper guide unit having an upper guide.
Figure 13:
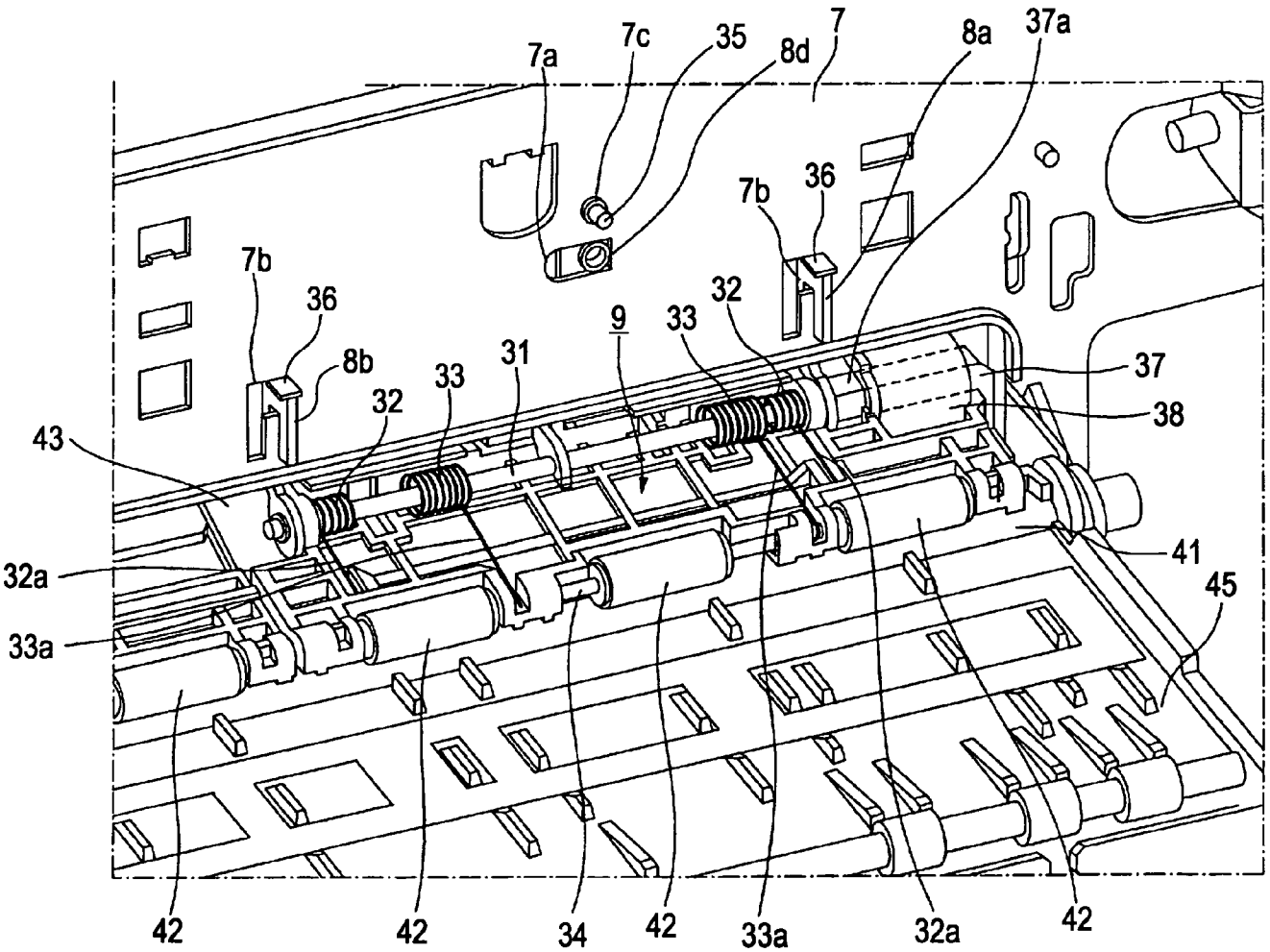
FIG. 13 is a diagram illustrating the vicinity of the upper guide unit from view of a platen side.
Figure 14:
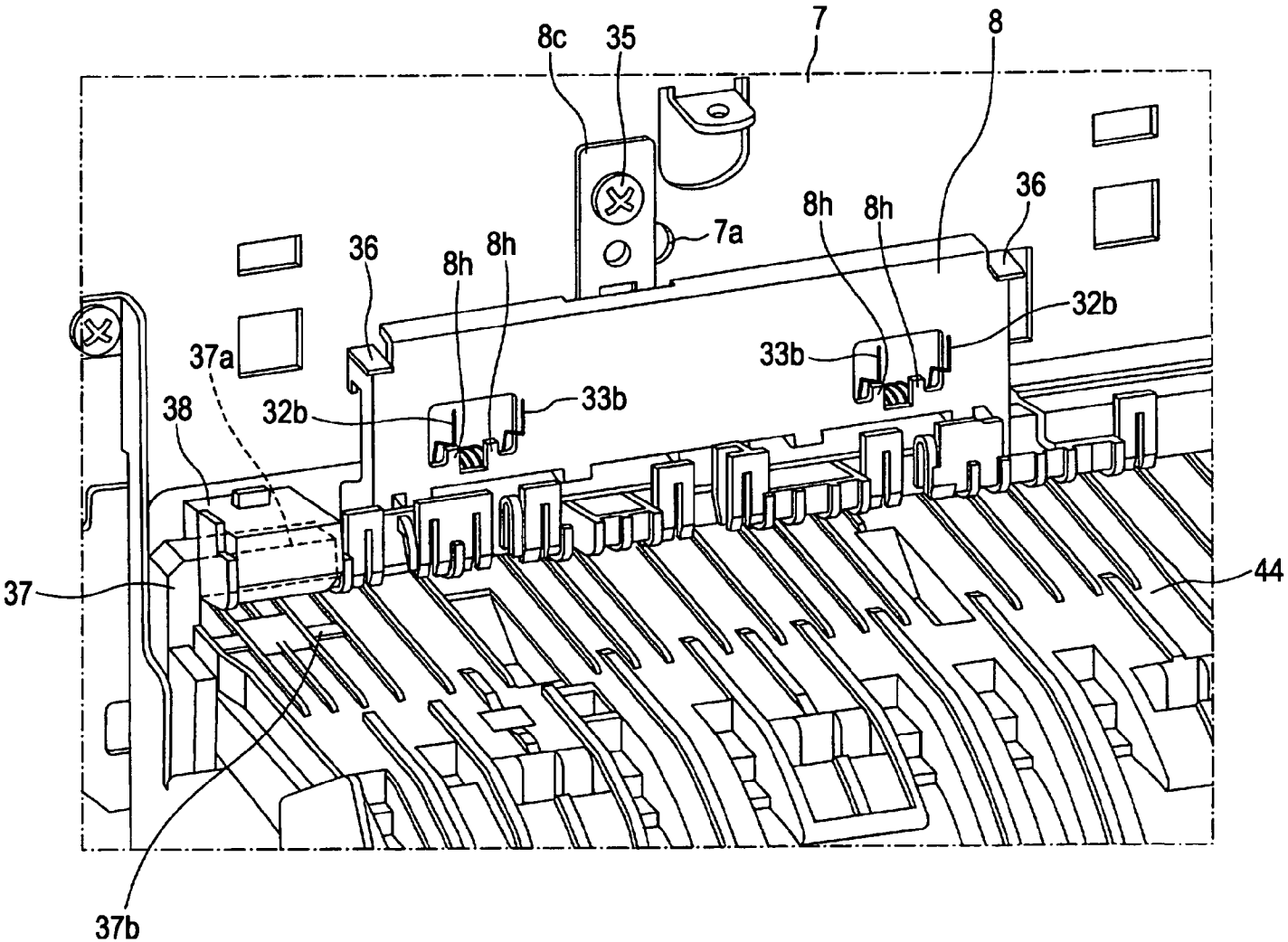
FIG. 14 is a diagram illustrating the vicinity of the upper guide unit from view of feeding side.

FIG. 12 is a diagram illustrating an upper guide unit 9 having an upper guide 43. FIG. 13 is a diagram illustrating the vicinity of the upper guide unit from view of a platen side. FIG. 14 is a diagram illustrating the vicinity of the upper guide unit 9 from view of feeding side. Hereinafter, the upper guide 43 will be described with reference to FIGS. 12 to 14 in addition to FIG. 1.

The upper guide unit 9 is a unit for retaining the above-described upper guide 43 and the transport-side driven roller 42 so as to be pivotable on the apparatus main body. The upper guide unit 9 includes a sub frame 8, a pivotable shaft 31, a first coil spring 32, a second coil spring 33, and roller shaft 34 in addition to the above-described upper guide 43 and the transport-side driven roller 42.

The sub frame 8 is formed in the manner that a metal plate is bent. The sub frame 8 is attached to a main frame 7 of the apparatus main body. Hooks 8*a* and 8*b*, a flange piece 8*c*, and bearing portions 8*f* and 8*g* are formed in the sub frame 8. The hooks 8*a* and 8*b* are configured to be suspended by a fixation portion 7*b* (see FIG. 13) formed in the main frame 7. A boss 8*d* and a long hole 8*e* are formed in the flange piece 8*c*. The boss 8*d* of the flange piece 8*c* is inserted into a hole 7*a* of the main frame 7. The long hole 8*e* is a hole in which the sub frame 8 is fixed by a fixation screw 35 in the hole 7*c* of the main frame 7. The bearing portions 8*f* and 8*g* re bearings that support the pivotable shaft 31.

The pivotable shaft 31 is a shaft that supports the upper guide 43 so as to be pivotable on the sub frame 8. The pivotable shaft 31 is supported to the sub frame 8 through the bearing portions 8*f* and 8*g* and supports the upper guide 43 to be pivotable through a shaft hole formed in the upper guide 43. In addition, the upper guide 43 is pivotable as much as the thickness of paper.

The first coil spring 32 grants a rotation force about the pivotable shaft 31 between the sub frame 8 and the upper guide 43. The rotation force is granted to the upper guide 43 so as to be moved in a direction in which the transport-side driven roller 42 is lowered about the pivotable shaft 31. In this way, the pivotable shaft 31 is positioned at the coil center of the first coil spring 32. In addition, one end of the first coil spring 32 is suspended by the sub frame 8 through a hook portion 8*h* and the other end thereof presses the upper guide 43 from the top surface thereof.

The second coil spring 33 grants the rotation force about the pivotable shaft 31 between the sub frame 8 and the roller shaft 34. The rotation force stabilizes the roller shaft 34 on the upper guide 43 and grants a rotation force in the direction, where the transport-side driven roller 42 is moved downward about the pivotable shaft 31, through the roller shaft 34 in the upper guide 43. In this way, the pivotable shaft 31 is positioned at the coil center of the second coil spring 33. In addition, one end of the second coil spring 33 is suspended in the sub frame 8 through the hook portion 8*h* and the other end thereof presses the roller shaft 34 from the an upside.

The roller shaft 34 is a shaft that rotatably supports the transport-side driven roller 42. The upper guide 43 supports the roller shaft 34. Since a spring force of the second coil spring 33 is applied from the upside, the roller shaft 34 is supported so as not to be deviated from the upper guide 43.

Seal Member

The upper guide 43 is required to guide the paper sheet P so as to pass through the optical sensor 37. Accordingly, a concave portion 43*a* is formed in the upper guide 43 and the upper protrusion portion 37*a* of the optical sensor 37 is configured so as to be inserted into the concave portion 43*a*. In this way, the paper sheet P guided to the upper guide 43 is configured so as to pass below the upper protrusion portion 37*a* of the optical sensor 37 inserted into the concave 43*a*.

Meanwhile, like the foregoing description in FIG. 9B, when the upper guide 43 guides the paper sheet P, it is required to prevent the front end (the rear end at the time of the back transport) of the paper sheet P from becoming inserted into the boundary between the upper guide 43 and the upper protrusion portion 37*a* of the optical sensor 37. However, since the upper guide 43 is supported so as to be pivotable on the main frame 7 and the optical sensor 37 is fixed to the lower guide 44, the upper guide 43 is relatively postured relative to the upper protrusion portion 37*a* of the optical sensor 37. That is, it is required to prevent the front end (the rear end at the time of the backward transport) of the paper sheet P from becoming inserted in the boundary between the upper guide 43 and the upper protrusion portion 37*a* which are relatively postured.

In this embodiment, since the seal member 38 covers the boundary between the upper guide 43 and the upper protrusion portion 37*a*, the front end (the rear end of the backward transport) of the paper sheet P is prevented from becoming inserted into the boundary between the upper guide 43 and the upper protrusion portion 37*a*. Hereinafter, the seal member 38 will be described.

Figure 15A:
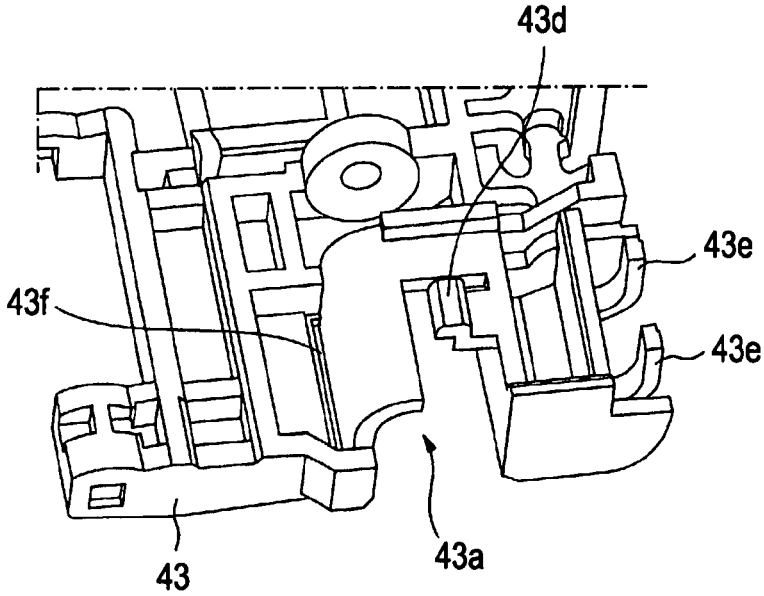
FIGS. 15A to 15C show that a seal member is attached to the upper guide.
Figure 15B:
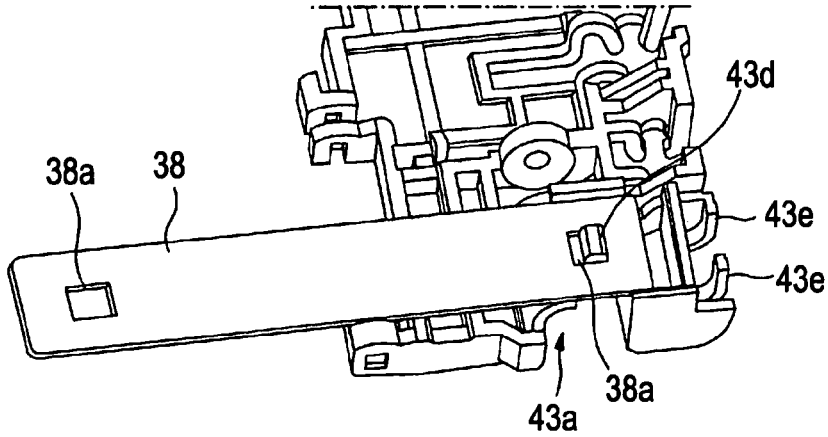
Figure 15C:
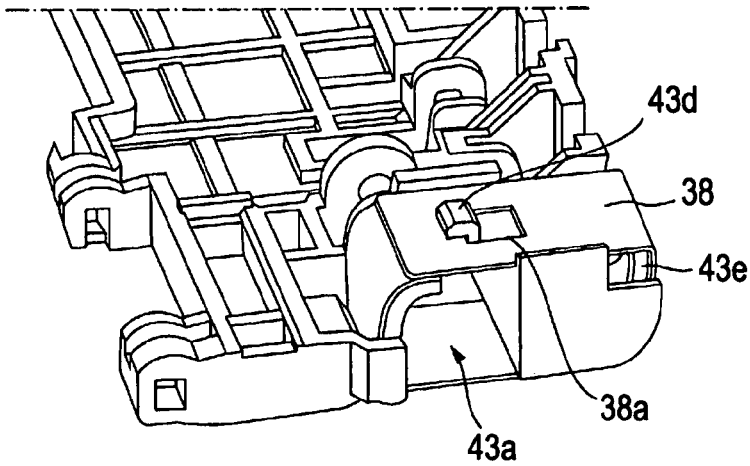

FIGS. 15A to 15C show that a seal member 38 is attached to the upper guide 43.

The seal member 38 is a member that has a flexible sheet shape (or a film shape), and specifically is a PET film. Holes 38*a* and 38*b* are formed at the vicinity of both ends of the seal member 38. A hook 43*d* is formed above the concave portion 43*a* of the upper guide 43. The seal member 38 is rolled through a through-hole 43*f* in the manner the hole 38*a* is suspended by the hook 43*d* and the seal member 38 is retained in the upper guide 43 in the manner that the hole 38*b* is suspended by the hook 43*d*. A tension-granting portion 43*e*, which is formed in the upper guide 43, prevents the seal member 38 from being bent.

Figure 16:
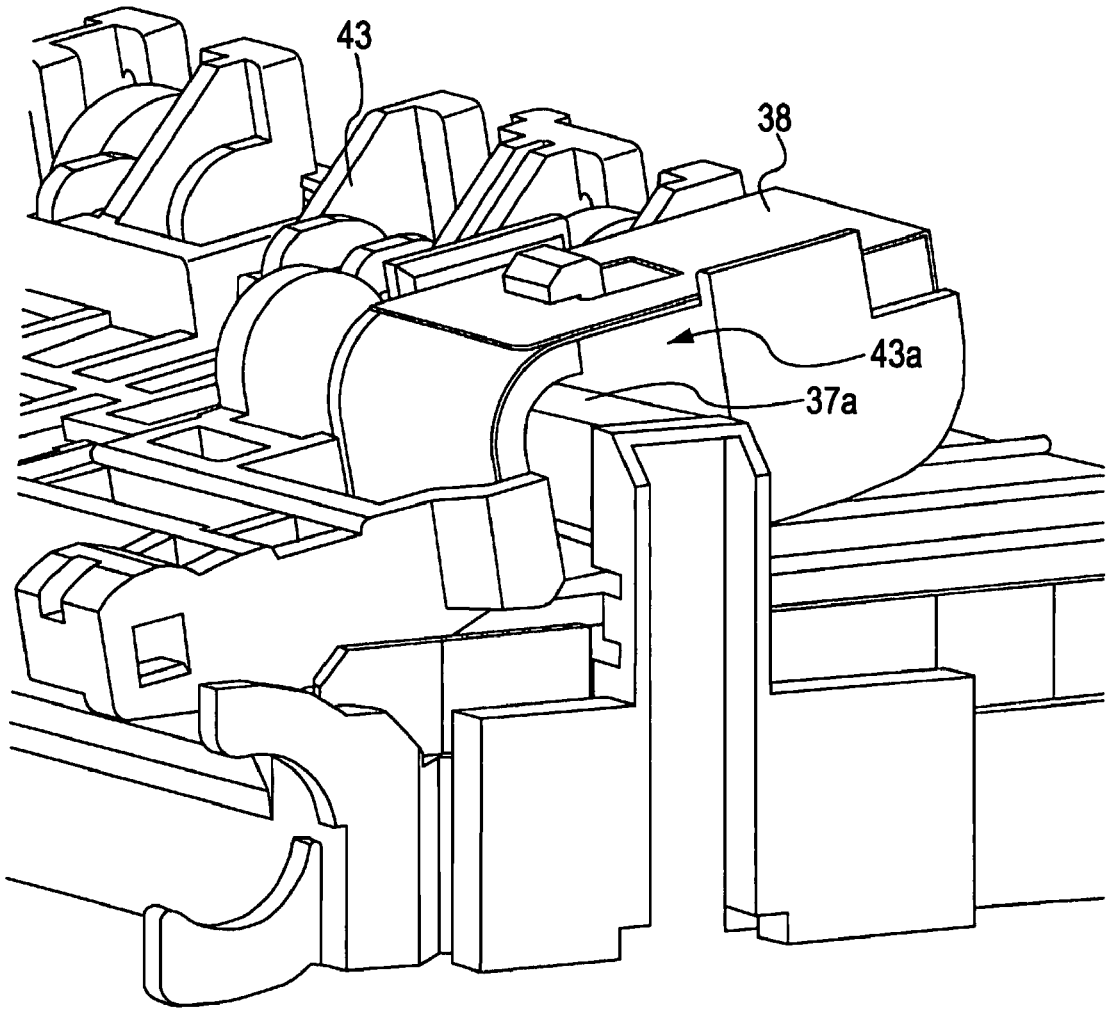
FIG. 16 shows that an upper protrusion portion is inserted into a concave portion.
Figure 17:
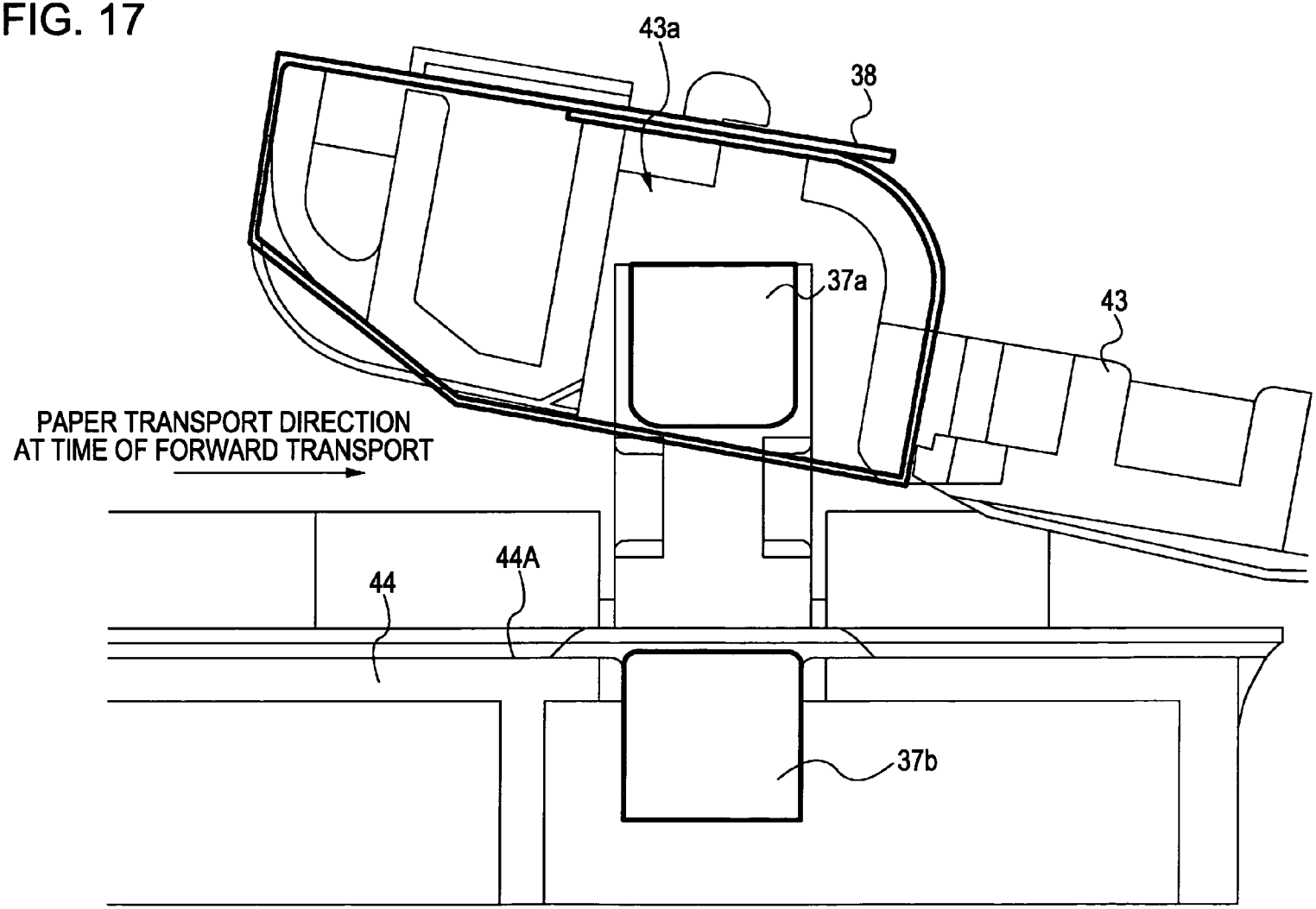
FIG. 17 is a diagram explaining a relationship between the seal member and the upper protrusion portion.

FIG. 16 shows that an upper protrusion portion 37*a* is inserted into a concave portion 43*a*. FIG. 17 is a diagram explaining a relationship between the seal member 38 and the upper protrusion portion 37*a*.

When the seal member 38 is rolled in the upper guide 43, a space is formed surrounded by the concave portion 43*a* and the seal member 38. The upper protrusion portion 37*a* of the optical sensor 37 is inserted into the space.

As shown in FIG. 17, the seal member 38 seals the boundary between the upper guide 43 and the upper protrusion portion 37*a*. In this way, it is possible to prevent the front end (the rear end of the backward transport) of the paper sheet P from becoming inserted into the boundary between the upper guide 43 and the upper protrusion portion 37*a*. Moreover, even when the upper guide 43 is pivoted, and thus the upper protrusion portion 37*a* comes in contact with the seal member 38, the seal member 38 is deformed so that the boundary between the upper guide 43 and the upper protrusion portion 37*a* keep to be sealed. That is why the seal member 38 is formed of a flexible material.

Since the seal member 38 is rolled in the upper guide 43 so as to be retained, the seal member 38 can seal both boundaries between the upper guide 43 and the upper protrusion portion 37*a* (a boundary between the upper guide 43 of the through-hole 43*f* and the upper protrusion portion 37*a* and the a boundary between the upper guide 43 of the tension-granting portion 43*e* and the upper protrusion portion 37*a*). In this way, it is possible to prevent the front end (the rear end of the backward transport) of the paper sheet P from becoming inserted into the boundary between the upper guide 43 and the upper protrusion portion 37*a* not only in the forward transport, but also in the backward transport.

A portion filling the concave portion 43*a* in the seal member 38 is positioned between the upper protrusion portion 37*a* and the lower protrusion portion 37*b* of the optical sensor 37. The portion of the seal member 38 may formed so as to fill an area of the optical axis of the optical sensor 37 or so as not to fill the area of the optical axis. When the seal member 38 is formed so as to avoid the area of the optical axis of the optical sensor 37, the seal member 38 may be made of a light-shielding material. Alternatively, when the seal member 38 is formed so as to fill the area of the optical axis of the optical sensor 37, the seal member 38 is required to be made of a transparent material.

Platen 45

Figure 18:
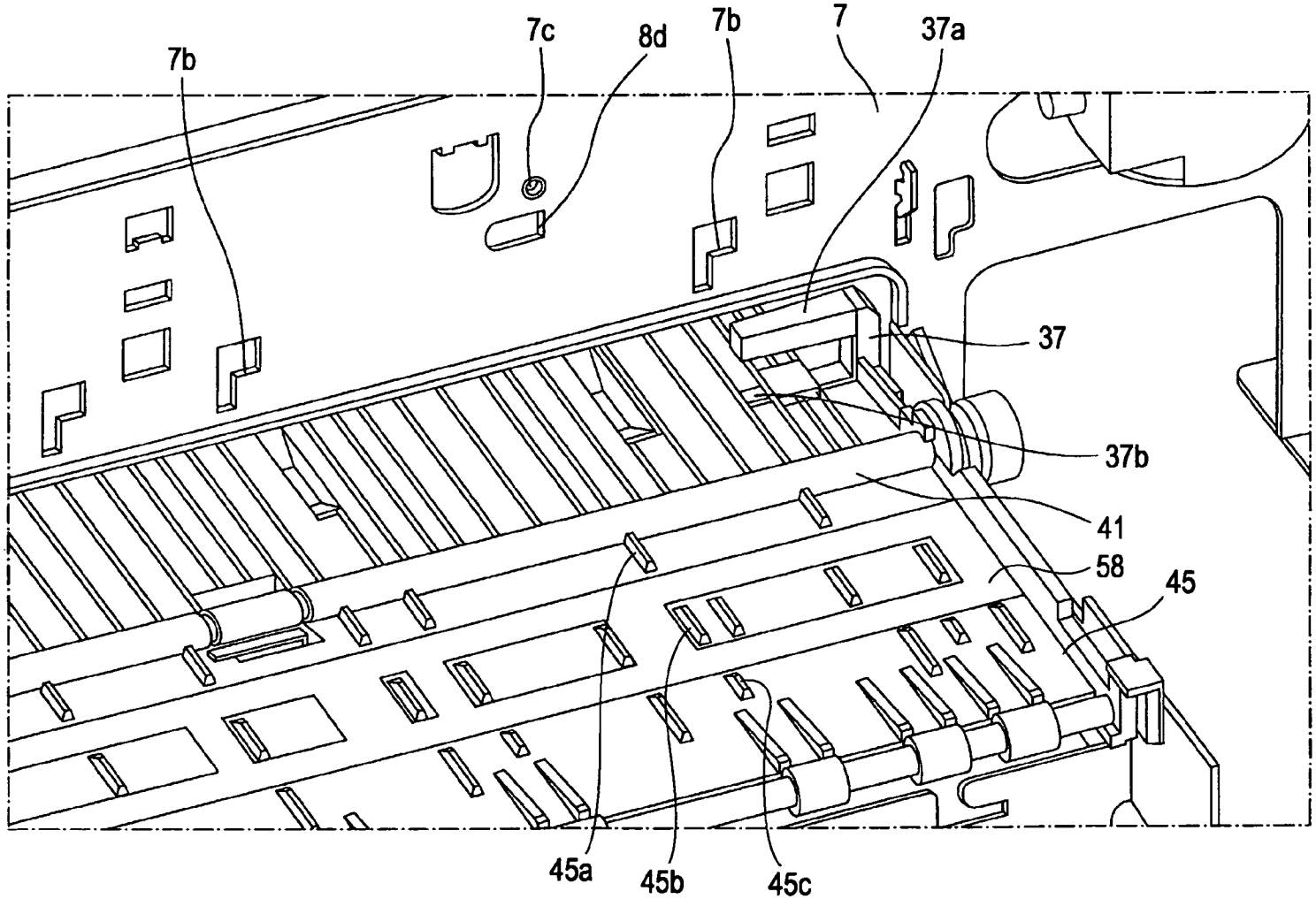
FIG. 18 is a diagram illustrating a platen when viewed obliquely.

FIG. 18 is a diagram illustrating a platen 45 when viewed obliquely. In order to simplify a configuration shown in FIG. 18, the upper guide unit 9 is not separated. Upstream-side bulges 45*a*, in-between bulges 45*b*, and downstream bulges 45*c* are formed in the platen 45. A sponge 58 absorbing ink is inserted in the platen 45. The sponge 58 is an absorber absorbing ink which is not deposited on the paper sheet P in a printing process with no margin.

Figure 19A:
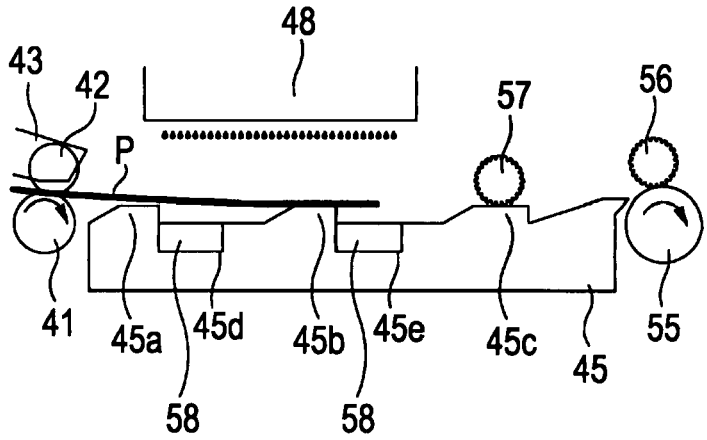
FIG. 19A shows that the front end of the paper sheet P is printed in a printing process with no margin.

FIG. 19A shows that the front end of the paper sheet P is printed in the printing process with no margin. As shown in FIG. 19A, an upstream-side groove 45*d* and a downstream-side groove 45*e* are formed in the platen 45 and the sponge 58 is inserted into the upstream-side groove 45*d* and the downstream-side groove 45*e*. The upstream-side groove 45*d* is formed between the upstream-side bulge 45*a* and the in-between bulge 45*b* and the downstream-side groove 45*e* is formed between the in-between bulge 45*b* and the downstream-side bulge 45*c*.

When the dots are printed on the front end of the paper sheet P in the printing process with no margin, first, the controller 10 rotates the transport roller 41 to transport the paper sheet P so that the front end of the paper sheet P is placed on the downstream-side groove 45*e*. In addition, the controller 10 controls the head 48 to eject ink so that an image is printed on the front end of the paper sheet P. At this time, the ink which is not deposited on the paper sheet P is absorbed by the downstream-side groove 45*e*.

Figure 19B:
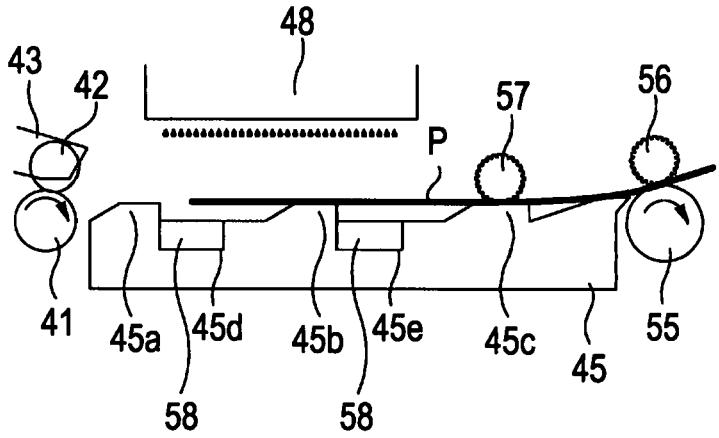
FIG. 19B shows that the rear end of the paper sheet P is printed in the printing process with no margin.

FIG. 19B shows that the rear end of the paper sheet P is printed in the printing process with no margin.

When the dots are printed on the rear end of the paper sheet P in the printing process with no margin, the head 48 ejects the ink in the state where the rear end of the paper sheet P is placed on the upstream-side groove 45*d* to print an image on the rear end of the paper sheet P. At this time, the ink which is not deposited on the paper sheet P is absorbed by the upstream-side groove 45*d*.

Figure 19C:
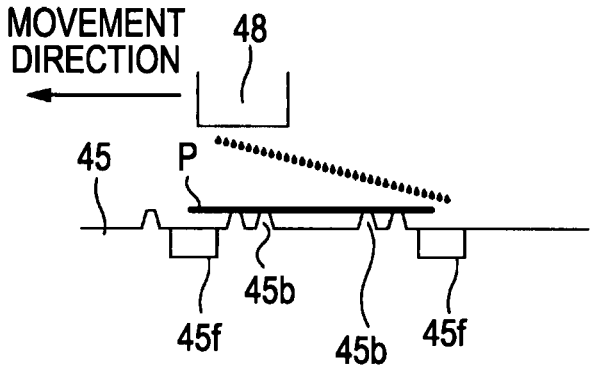
FIG. 19C shows that the side end of the paper sheet P is printed in the printing process with no margin.

FIG. 19C shows that the side end of the paper sheet P is printed in the printing process with no margin. As shown in FIG. 19C, a lateral groove 45*f* is provided in the platen 45 and the sponge 58 is inserted into the lateral groove 45*f*.

When the dots are printed on the paper sheet P with a standard size, the lateral end (the lateral side) of the paper sheet P is placed on the lateral groove 45*f*. The head 48 ejects the ink on an area which is broader than the paper surface, and then the image is formed on the entire width of the paper sheet P. At this time, the ink which is not deposited on the paper sheet P is absorbed by the sponge 58 of the lateral groove 45*f*.

As shown in FIGS. 19A and 19B, an inclined plane is configured on the upstream side in the transport direction of the upstream-side bulge 45*a*, the in-between bulge 45*b*, and the downstream-side bulge 45*c*. The reason why the inclined plane is formed in the bulges in this way is that the front end of the paper sheet P is prevented from becoming jammed in the bulges when the paper sheet P is transported.

Alternatively, as shown in FIGS. 19A and 19B, the inclined plane is not configured in the downstream side in the transport direction of the upstream-side bulge 45*a*, the in-between bulge 45*b*, and the downstream-side bulge 45*c*. If the inclined plane is configured in the downstream side in the transport direction of the bulges, the front end of the paper sheet P easily comes in contact with the sponge 58. Accordingly, the other surface of the paper sheet P may be smeared.

Printing Process of Both Sides

Figures 20, 20A:
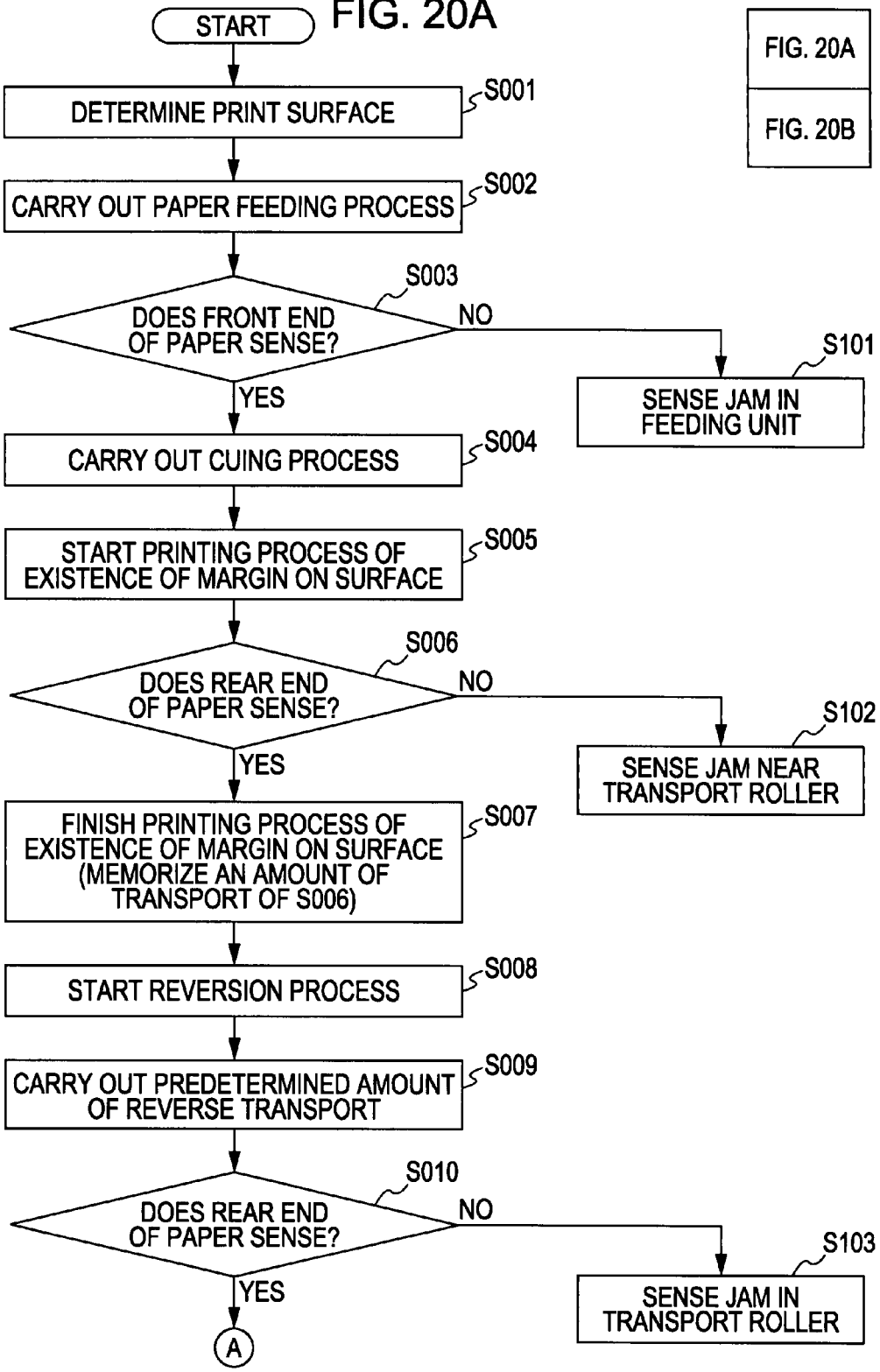
FIG. 20 is a flow chart illustrating a printing process of both surfaces according to an embodiment.
Figure 20B:
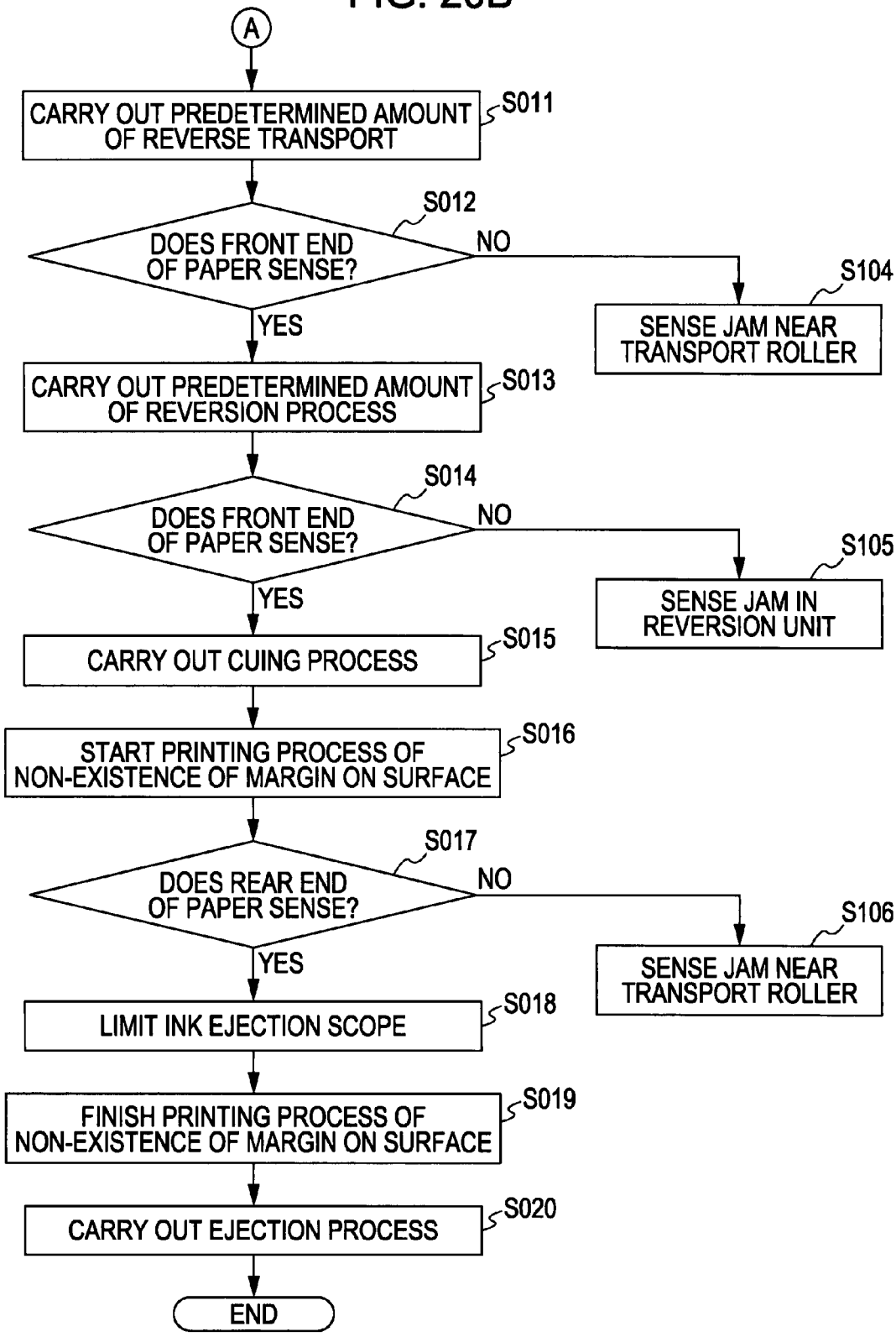

FIG. 20 is a flow chart illustrating a printing process of both surfaces according to an embodiment. In a printing process of both sides according to the embodiment, one surface and the other surface are assumed to be configured to be "a printing process with a margin" and "the printing process with no margin", respectively. For example, when a new year's card is printed, a recipient, an address, etc. are printed on the one surface and a photo is printed on the other surface. At this time, the one surface and the other surface correspond to "the printing process with the margin" and "the printing process with no margin".

First, the controller 10 carries out a determination of a printing surface (S001). Specifically, the controller 10 determines an image about the existence of margin to be printed on the one surface of the paper sheet P and an image about the non-existence of the margin to be printed on the other surface of the paper sheet P. For example, when a new year's card is printed, the controller 10 determine a recipient, an address, etc. to be printed on the one surface of the paper sheet P and a photo to be printed on the other surface. In addition, in order to carry out the printing process in such an order, the controller 10 controls a direction in which a postcard is set to be displayed on a display unit (a liquid crystal panel, etc.) which is not shown. In the case of the rear feeding process, when the postcard is set so that a surface on which a recipient, an address, etc are printed is faced upward, the recipient, the address, etc. can be printed on the one surface and the photo can be printed on the other surface.

Next, the controller carries out a paper feeding process. The controller 10 controls the rear feeding roller 11 to rotate in the case of the rear feeding process and the front feeding roller 28 to rotate in the case of the front feeding process as much as a predetermined amount of rotation (S002, see FIGS. 3 and 4).

When the feeding process is normally carried out, the front end of the paper sheet P reaches the optical sensor 37, and then the optical sensor 37 senses the front end of the paper sheet P (YES in S003). Even when the controller 10 rotates the rear feeding roller 11 or the front feeding roller 28 as much as the predetermined amount of rotation, and then the optical sensor 37 does not sense the front end of the paper sheet P (NO in S003), the controller 10 senses that jam (paper jam) occurs in the feeding unit (S101). In this case, the controller 10 displays the jam occurrence and the jam occurrence location (in this case, the inside of the feeding unit) on the display unit (the liquid crystal panel, etc) which is not shown.

When the optical sensor 37 senses the front end of the paper sheet P (YES in S003), the controller 10 controls the paper sheet P to be transported as much as a predetermined transport so as to transport the paper sheet P to a print start position (where the process is referred to as "a cuing process") (S004). Moreover, an amount of transport in the manner that the optical sensor 37 senses the front end of the paper sheet P, and then controller 10 transports the paper sheet P to the print start position is predetermined. In this way, the controller 10 carries out the cuing process on the basis of the result that the optical sensor 37 senses. After the cuing process, the paper sheet P is opposed with the head 48.

Next, the controller 10 controls the printing process with the margin on the one surface of the paper sheet P (S005). At this time, the controller 10 alternately repeats a dot formation process in which dots are formed on the paper sheet P in the manner of ejecting ink from the head 48 in the middle of movement of the carriage 46 and a transport process in which the paper sheet P is transported as much as a predetermined amount of transport. When the transport process continues several times, the rear end of the paper sheet P reaches the optical sensor 37.

Even when predetermined times of the transport process are carried out, but the optical sensor 37 does not sense the rear end of the paper sheet P (NO in S006), the controller 10 senses that jam occurs in the vicinity of the transport roller 41 (S102). In this case, the controller 10 displays the jam occurrence and the jam occurrence location (in this case, the vicinity of the transport roller) on the display unit (the liquid crystal panel, etc) which is not shown.

After the optical sensor 37 senses the rear end of the paper sheet P (YES in S006), the printing process with the margin continues for some time, and then the printing process on the one surface ends (S007).

Figure 21:
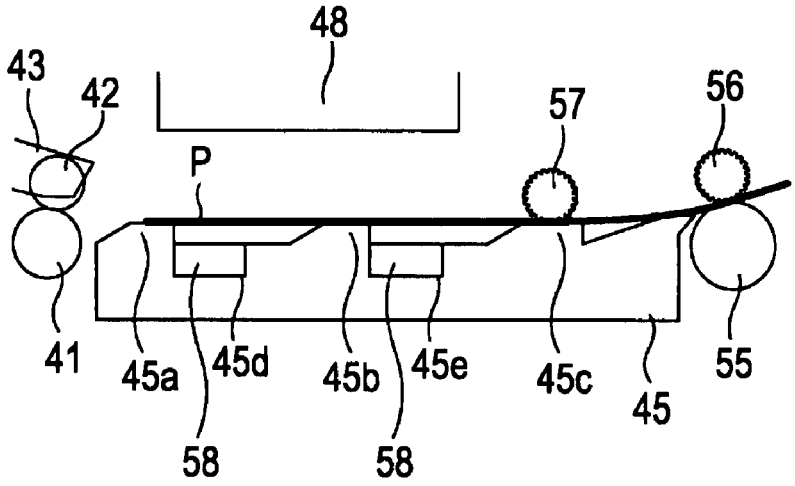
FIG. 21 is a diagram illustrating a position of the rear end of the paper sheet P at the time of finishing a surface printing process.

FIG. 21 is a diagram illustrating a position of the rear end of the paper sheet P at the time of finishing a surface printing process. As shown in FIG. 21, the rear end of the paper sheet P is supported by the upstream-side bulge 45*a*. Alternatively, the rear end of the paper sheet P may be placed in the more upstream side (a left side in FIG. 21) than the upstream-side bulge 45*a*. However, in this embodiment, the rear end of the paper sheet P is prohibited from being placed in a more downstream side (a right side in FIG. 21) than the upstream-side bulge 45*a* at the time of finishing the printing process on the one surface. Namely, in this embodiment, the controller 10 controls the printing process with the margin on the one surface so that the rear end of the paper sheet P is not placed in the more downstream side than the upstream-side bulge 45*a* at the time of finishing the printing process on the one surface. Moreover, the optical sensor 37 senses the rear end of the paper sheet P, and then the controller 10 memorizes the amount of transport until the printing process with the margin ends Next, the controller 10 starts a reversion process (S008). When the backward transport is carried out in the case shown in FIG. 21, the rear end of the paper sheet P passes through the transport roller 41, and afterward passes through the optical sensor 37.

Even when the backward transport is carried out as much as a predetermined amount of transport (S009), but the optical sensor 37 does not sense the rear end of the paper sheet P (NO in S010), the controller 10 senses that jam occurs in the transport roller 41 (S103). In this case, it is assumed that the rear end of the paper sheet P cannot pass through the transport roller 41. A reference of the predetermined amount of transport in S009 is set depending on the amount of transport memorized in S007. The larger the amount of transport memorized is in S007, the larger the reference of the predetermined amount of transport is set. The controller 10 displays the jam occurrence and the jam occurrence location (in this case, the transport roller) on the display unit (the liquid crystal panel, etc) which is not shown.

After the optical sensor 37 senses the rear end of the paper sheet P (YES in S010), the controller 10 further carries out the predetermined amount of transport (S011). Even when the backward transport is carried out as much as the predetermined amount of transport, but the optical sensor 37 does not sense the rear end of the paper sheet P (NO in S012), the controller 10 senses that jam occurs in the vicinity of the transport roller 41 (S104). In this case, the controller 10 displays the jam occurrence and the jam occurrence location (in this case, the vicinity of the transport roller) on the display unit (the liquid crystal panel, etc) which is not shown.

When the optical sensor 37 senses the front end of the paper sheet P (YES in S012), it is assumed that the paper sheet P is supplied to the reversion unit 100. Subsequently, the controller 10 carries out a reverse process as much as a predetermined amount of reversion (S013). That is, the controller 10 controls the first roller 102 and the second roller 104 to rotate as much as a predetermined amount of rotation. When the reversion process is carried out as much as the predetermined of reversion, the front end (the rear end in the printing process of the one surface) of the paper sheet P reaches the optical sensor 37.

Even when the reversion process is carried out as much as the predetermined amount of reversion, but the optical sensor 37 does not sense the rear end of the paper sheet P (NO in S014), the controller 10 senses that jam occurs in the reversion unit 100 (S105). Moreover, it is assumed that the paper sheet P is jammed in the inside of the reversion unit 100. The controller 10 displays the jam occurrence and the jam occurrence location (in this case, the inside of the reversion unit) on the display unit (the liquid crystal panel, etc) which is not shown.

After the optical sensor 37 senses the front end of the paper sheet P (YES in S014), the controller 10 carries out the cuing process in which the printing process is carried out on the other surface (S015). Since the printing process with no margin is carried out in the printing process on the other surface, the front end of the paper sheet P after the cuing process is placed on the downstream-side groove 45*e* (see FIG. 19A).

Next, the controller 10 controls the printing process with no margin on the other surface of the paper sheet P to be started (S016). At this time, the controller 10 alternately repeats the dot formation process in which dots are formed on the paper sheet P in the manner of ejecting ink from the head 48 in the middle of movement of the carriage 46 and the transport process in which the paper sheet P is transported as much as a predetermined amount of transport. Moreover, when the printing process with no margin on the front end of the paper sheet P is carried out, the ink which is not deposited on the paper sheet P is absorbed by the sponge 58 of the downstream-side groove 45*e* (see FIG. 19A). When the printing process with no margin on the lateral end of the paper sheet P, the ink which is not deposited on the paper sheet P is absorbed by the sponge 58 of the lateral-side groove 45*f* (see FIG. 19C). When the transport process continues several times in the printing process with no margin on the other surface, the rear end of the paper sheet P reaches the optical sensor 37.

Even when a predetermined number of times of the transport process is carried out several times, but the optical sensor 37 does not sense the rear end of the paper sheet P (NO in S017), the controller 10 senses that jam occurs in the vicinity of the transport roller 41 (S106). In this case, the controller 10 displays the jam occurrence and the jam occurrence location (in this case, the vicinity of the transport roller) on the display unit (the liquid crystal panel, etc) which is not shown.

After the optical sensor 37 senses the rear end of the paper sheet P (YES in S107), the controller 10 controls the ejection range of ink to be limited in the printing process on the rear end of the paper sheet P on the basis of the result sensed by the optical sensor 37. When the ink is ejected broadly, the ink is wasted and the sponge of the upstream-side groove 45*d* is smeared. Accordingly, the ink is ejected only in the proper range of ejection corresponding to location of the sensed rear end. Moreover, when the printing process with no margin on the rear end of the paper sheet P is carried out, the ink which is not deposited on the paper sheet P is absorbed by the sponge of the upstream-side groove 45*d* (see FIG. 19B).

The controller 10 controls an ejection process to be carried out after end of the printing process with no margin on the other-end surface (S019), and then printing process on both surface to be finished.

FIRST COMPARATIVE EXAMPLE

Figure 22:
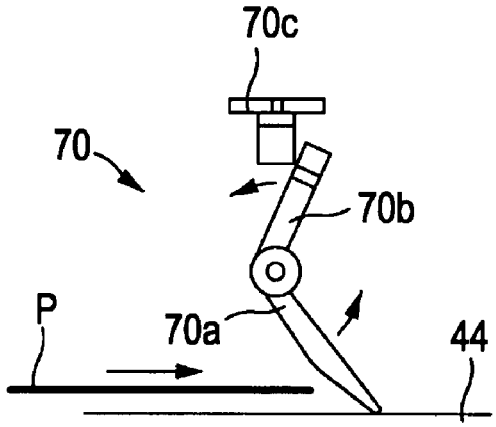
FIG. 22 is a diagram illustrating a sensor sensing the end of paper in a comparative example.

FIG. 22 is a diagram illustrating a sensor sensing the paper end in a comparative example. A paper-end sensor 70 in the comparative example includes a lever 70*a*, a light-shielding portion 70*b*, and a sensor unit 70*c*. When the front end of the paper sheet P reaches the paper-end sensor 70, the front end of the paper sheet P raises the lever 70*a*. Subsequently, the light-shielding portion 70*b* rotates and is inserted between a light-emitting portion and a light-receiving portion (not shown) of the sensor unit 70*c* so that the paper-end sensor 70 senses the front end of the paper sheet P. Moreover, when the rear end of the paper sheet P passes through the lever 70*a*, the lever 70*a* returns to the original position and the paper-end sensor 70 senses the rear end of the paper sheet P.

In such a comparative example, since the paper sheet P is not required to be guided to the narrow portion between the light-receiving portion 371 and the light-emitting portion 372 like the optical sensor 37 according to the embodiment, the above-described upper guide 43 is not required.

However, since the paper-end sensor 70 cannot sense the paper end except for the forward transport of the paper sheet P, the paper-end sensor 70 cannot sense the paper end during the backward transport of the paper sheet P.

In such a comparative example, the optical sensor 37 according to the embodiment senses the front end of the rear end of the paper sheet P in the non-contact manner. Accordingly, even during the backward transport of the paper sheet P, the optical sensor 37 can sense the paper end. In addition, in the above-described embodiment, such an optical sensor 37 can sense the rear end of the paper sheet P in the backward transport so as to detect the jam in the transport roller *see S010 and S103 shown in FIG. 20). Alternatively, the optical sensor 37 can sense the front end of the paper sheet P in the backward transport so as to detect the jam in the vicinity of the transport roller (see S012 and S104 shown in FIG. 20).

SECOND COMPARATIVE EXAMPLE

Figure 23A:
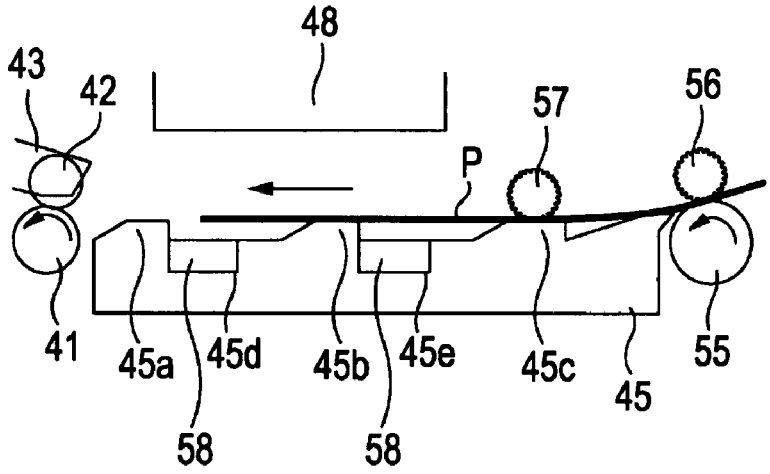
FIGS. 23A and 23B are diagrams explaining the surface printing process in the comparative example.
Figure 23B:
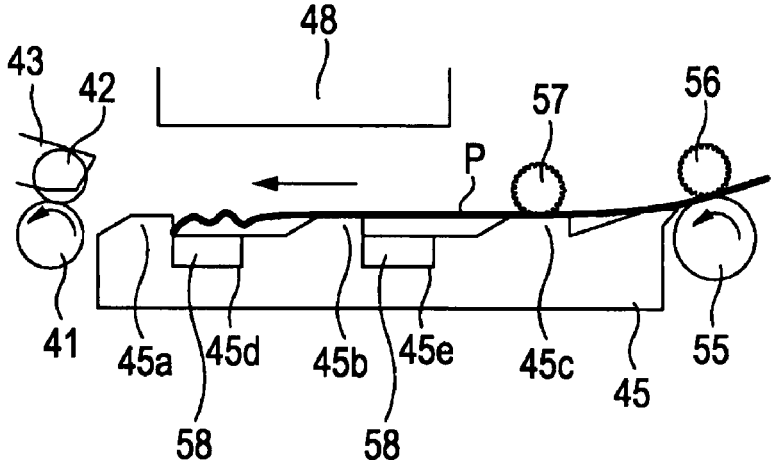

FIGS. 23A and 23B are diagrams explaining the surface printing process in the comparative example. In the comparative example, the printing process with no margin is carried out when an image is printed on the one surface in the printing process of the both surface.

Like the foregoing description in FIG. 19B, the rear end of the paper sheet P is placed on the upstream-side groove 45*d* when an image is printed on the rear end of the paper sheet P in the printing process with no margin. In this way, in the comparative example, when the printing process of the one surface ends, and then the paper sheet P is transported backward so as to be reversed, the backward transport is started in the manner shown in FIG. 23A.

Meanwhile, an inclined plane is configured on the downstream side in the transport direction of the upstream-side bulge 45*a* (in order that the front end of the paper sheet P does not come in contact with the sponge 58). In this way, when the backward transport is carried out from a state shown in FIG. 23A, as shown in FIG. 23B, the rear end of the paper sheet P is jammed by the upstream-side bulge 45*a*. Accordingly, the paper sheet P may be easily jammed.

Unlike such a comparative example, the printing process with no margin is carried out when the image is printed on the other surface and the printing process with the margin is carried out when the image is printed on the one surface. In this way, it is possible to prevent the paper from becoming jammed as shown in FIG. 23B.

OTHER EMBODIMENTS

The above-described embodiment is described with reference to the printer, but may be described with reference to a printing apparatus, a recording apparatus, a liquid ejecting apparatus, a printing method, a recoding method, a liquid ejection method, a printing system, a recording system, a computer system, a program, a memory medium memorizing a program, a display screen, a screen displaying method, a prints manufacturing method, etc.

Moreover, the printer and the like according to the embodiment is described, but the embodiment is described to easily understand the gist of the invention and the invention is not limited thereto. The invention may be modified and improved without deviation of the gist of the invention and may include the equivalents.

About Printer

In the above-described embodiment, the printer is described, but the invention is not limited thereto. For example, the technology related to the embodiment may be applied to various printing apparatus such as a color filter manufacturing apparatus, a dye apparatus, a micro treatment apparatus, a semiconductor manufacturing apparatus, a surface treatment apparatus, a three-dimensional modeling apparatus, a liquid vaporization apparatus, an organic EL manufacturing apparatus (in particular, a polymer EL manufacturing apparatus), a display manufacturing apparatus, a film coating apparatus, or a DNA chip manufacturing apparatus to which ink jet technology is applied.

About Ink

In the above-described embodiment, dye ink or pigment ink is ejected from nozzles with reference to the printer. However, a liquid ejected from the nozzles is not limited to such ink. For example, the liquid (including water) including a metal material, an organic material (in particular, a polymer material), a magnetic material, a conductive material, a wiring material, a film coating material, electronic ink, machining fluid, and gene solution, may be ejected from the nozzles.

About Nozzle

In the above-described embodiment, the ink is ejected using a piezoelectric element. However, the liquid ejecting method is not limited thereto. For example, another method such as a method of generating bubbles in nozzles by heat may be used.

CONCLUSION (1) The above-described printing apparatus 1 (one example of a printing apparatus) includes a transport unit 5, an ejection unit 6 (one example of a transport mechanism), a head 48, an optical sensor 37, a reversion unit 100 (one example of a reversion mechanism), and a controller 10. In addition, when printing an image on an one surface of a medium, a controller 10 controls paper sheet P (one example of a medium) to be transported to the transport unit 5 and the ejection unit 6 in a manner of a forward transport (to transport in a forward direction) and controls the optical sensor 37 to sense an end of the paper sheet P.

In this case, when the sensor shown in FIG. 22 is used, the sensor can sense the end of the paper which is forward transported. However, the sensor can sense the end of the paper which is backward transported.

Accordingly, in the above-described embodiment, the optical sensor 37 capable of sensing existence or non-existence of paper (one example of the medium) in a non-contact manner is used. In this way, when transporting the paper sheet P to the transport unit 5 and the ejection unit 6 in the manner of the backward transport (to transport in a backward direction) in order to reverse the paper sheet P to the reversion unit 100 after a printing process of the one surface, the controller 10 can controls the optical sensor 37 to sense the end of the paper sheet P.

(2) According to the above-described embodiment, the optical sensor 37 includes a light-emitting portion 372 and a light-receiving portion 371 (see FIG. 1). When using such a sensor, it is desirable to shorten a distance between the light-emitting portion 372 and the light-receiving portion 371 to improve a sensing precision. Moreover, it is required that the paper sheet P passes between the light-emitting portion 372 and the light-receiving portion 371.

In this way, the above-described printer 1 includes a lower guide 44 and an upper guide 43 guiding the paper sheet P between the light-emitting portion 372 and the light-receiving portion 371. Accordingly, it is possible to pass the paper sheet P between the light-emitting portion 372 and the light-receiving portion 371 by shortening the distance between the light-emitting portion 372 and the light-receiving portion 371.

(3) The above-described optical sensor 37 includes an upper protrusion portion 37*a* and a lower protrusion portion 37*b* and the upper protrusion portion 37*a* includes the light-receiving portion 371 and the lower protrusion portion 37*b* includes the light-emitting portion 372 (see FIG. 7). In this case, when the lower protrusion portion 37*b* is inserted into the lower guide 44, as shown in FIG. 9B, the paper sheet P may be jammed in a boundary between the lower guide 44 and the lower protrusion portion 37*b*. Thus, in the above-described lower guide 44, an insertion portion into which the lower protrusion portion 37*b* is inserted is formed and an opening 44*b* is formed in a position of an optical axis of the optical sensor 37.

Meanwhile, a base surface 44A and ribs 44B are formed in the lower guide 44 (see FIG. 11). In addition, when an opening 44D is formed in the rib 44B, as shown in FIG. 9B, the front end of the paper sheet P may be jammed in the boundary.

In this way, in the above-described embodiment, the opening 44D is formed on the base surface 44A between the ribs 44B. Since the paper sheet P comes in contact with the ribs 44B, but does not come in contact with the base surface 44A between the ribs 44B, the paper sheet P is not jammed in the boundary between the base surface 44A and the lower protrusion portion 37*b*. As a result, it is possible to prevent the paper sheet P from becoming jammed.

In the above-described embodiment, the upper protrusion portion 37*a* includes the light-receiving portion 371 and the lower protrusion portion 37*b* includes the light-emitting portion 372, and vise versa. However, when the light-receiving portion 371 is above the light-emitting portion 372, dust does not settle and it is possible to carry out a stable sensing process.

(4) The optical sensor 37 senses the existence or the non-existence of the paper sheet P in the manner that the light-receiving portion 371 senses light emitted from the light-emitting portion 372. Accordingly, if the distance between the light-emitting portion 372 and the light-receiving portion 371 becomes shortened, the sensing precision is improved. In this way, in the above-described embodiment, the top surface of the lower protrusion portion 37*b* is configured to be placed above the base surface 44A of the lower guide 44 (see FIG. 17). In this way, since the distance between the light-emitting portion 372 and the light-receiving portion 371 is shortened as much as possible, it is possible to improve the sensing precision of the optical sensor 37.

(5) An uplift portion 44C that covers the lower protrusion portion 37*b* is formed in the above-described lower guide 44 (see FIG. 11). Accordingly, it is possible to reduce an exposure portion in the boundary between the lower guide 44 and the lower protrusion portion 37*b*. Moreover, an inclined plane is formed between the uplift portion 44C and the base surface 44A on an upstream side in the transport direction and a downstream side in the transport direction of the uplift portion 44C (see FIG. 11). As a result, in the forward transport and the backward transport, it is possible to prevent the paper sheet P from becoming jammed in the uplift portion 44C.

(6) In the above-described embodiment, the optical sensor 37 is fixed to the lower guide 44 and the upper guide 43 is formed to be pivotable on the lower guide 44. In this way, a positional relationship between the upper guide 43 and the upper protrusion portion 37*a* of the optical sensor 37 is changed. Specifically, before and after a position in which the paper sheet P is jammed between the transport roller 41 and the transport-side driven roller 41, the positional relationship between the upper guide 43 and the upper protrusion portion 37*a* of the optical sensor 37 is changed. Meanwhile, it is required to prevent the front end of the paper sheet P from becoming jammed in the boundary between the upper guide 43 and the upper protrusion portion 37*a* of the optical sensor 37.

In this way, in the above-described embodiment, a flexible seal member 38 seals the boundary between the upper guide 43 and the upper protrusion portion 37*a* of the optical sensor 37. In this way, it is possible to prevent the front end of the paper sheet P from becoming inserted into the boundary between the upper guide 43 and the upper protrusion portion 37*a* of the optical sensor 37 which are relatively postured.

(7) In the above-described embodiment, an upstream-side bulge 45*a* (one example of a first bulge), an in-between bulge 45*b* (one example of a second bulge), and an upstream-side groove 45*d* (one example of a groove) are formed in a platen 45. In addition, in the printing process with no margin on the rear end, the controller 10 controls the paper sheet P to be transported to a transport unit 5 and an ejection unit 6 so as to place the rear end of the paper sheet P on the upstream-side groove 45*d*. Simultaneously, the controller 10 controls a head 48 to print an image on the rear end of the paper sheet P (see FIG. 19B).

However, when the printing process with no margin on the one surface is carried out, the rear end of the paper sheet P is jammed in the upstream-side bulge 45*a* in the backward transport, and thus the paper sheet P may be jammed.

The above-described controller 10 controls the paper sheet P to be transported to the transport unit 5 and the ejection unit 6 so as not to place the rear end of the paper sheet P on the more downstream side in the transport direction than the upstream-side bulge 45*a*. Simultaneously, the controller 10 controls the head 48 to print an image on the one surface. In addition, the controller 10 controls the paper sheet P to be transported to the transport unit 5 and the ejection unit 6 so as to place the rear end of the medium on the upstream-side groove 45*d*. Simultaneously, the controller 10 controls the head 48 to print an image on the rear end of the paper sheet P (see FIG. 19B). When an image on which a margin exists and an image on which a margin does not exist are printed on the paper sheet P in the printing process of both surface, the controller 10 controls the printing process with the margin on the one surface and the printing process with no margin on the other surface to be carried out.

In this way, in the backward transport after the printing process of the one surface, it is difficult the rear end of the paper sheet P to be jammed in the upstream-side bulge 45*a*. As a result, it is possible to reduce a possibility of paper jam.

(8) The above-described printing method (one example of a printing method) is carried out in the manner that the paper sheet P (one example of a medium), first, is fed to the transport unit 5 (one example of a transport mechanism), the optical sensor 37 (one example of a non-contact sensor) senses the front end of the paper sheet P before the paper sheet P is fed to the transport unit 5, the transport unit 5 and the ejection unit 6 forward transport the paper sheet P during the printing process of the one surface (one example of a printing process), and then the reversion unit 100 (one example of a reversion mechanism) backward transports the paper sheet P in order to reverse the paper sheet P after the printing process of the one surface. The above-described optical sensor 37 is a sensor capable of sensing the existence or the non-existence of the paper sheet P in a non-contact manner. Accordingly, the optical sensor 37 can sense the front end and the rear end of the paper sheet P in the manner of the backward transport.

What is claimed is:

1. A printing apparatus comprising:

(A) a transport mechanism transporting a medium in a forward direction and a backward direction;

(B) a head printing dots on the medium;

(C) a sensor sensing existence of the medium in a non-contact manner;

(D) a reversion mechanism reversing the medium; and (E) a controller controlling the sensor to sense an end of the medium when the transport mechanism transports the medium in the forward direction so as to allow the head to print the dots on a surface of the medium and controlling the sensor to sense the end of the medium when the transport mechanism transports the medium in the backward direction so as to allow the reversion mechanism to reverse the medium after the dots are printed on the surface thereof wherein the sensor includes a light-emitting portion and a light-receiving portion, and wherein the printing apparatus further comprises a lower guide and an upper guide for guiding the medium between the light-emitting portion and the light-receiving portion; and wherein the sensor includes an upper protrusion portion and a lower protrusion portion, wherein the upper protrusion portion includes one of the light-emitting portion and the light-receiving portion and the lower protrusion portion includes the other thereof, wherein the lower guide includes a base surface, ribs protruding upward from the base surface so as to come in contact with the medium, and an insertion portion in which the lower protrusion portion is inserted, and wherein an opening is provided at a position of an optical axis of the sensor in the lower guide and the opening is formed in the base surface between the ribs.

2. The printing apparatus according to claim 1, wherein the top surface of the lower protrusion portion is positioned above the base surface of the lower guide.

3. The printing apparatus according to claim 1, wherein the lower guide further includes a lift portion covering the lower protrusion portion, and wherein an inclined plane is formed between the base surface on an upstream side and a downstream side of the uplift portion in the forward direction.

4. The printing apparatus according to claim 1, further comprising a flexible seal member, wherein the sensor is fixed to the lower guide, wherein the upper guide is pivotable on the lower guide, and wherein the seal member seals a boundary between the sensor and the upper guide.

5. The printing apparatus according to claim 1, further comprising:

a first bulge supporting the medium;

a second bulge supporting the medium and being provided more downstream in the forward direction than the first bulge; and a groove formed between the first bulge and the second bulge, wherein the controller controls the transport mechanism to transport the medium so as not to position the rear of the medium more downstream than the first bulge, and simultaneously controls the head to print the dots on one surface of the medium, and wherein the controller controls the transport mechanism to transport the medium so as to position the rear of the medium in the groove, and simultaneously controls the head to print the dots on the rear end of the medium when printing the dots on the other-side of the medium.

* * * * *